US006402022B1

(12) United States Patent
Fabel

(10) Patent No.: US 6,402,022 B1
(45) Date of Patent: Jun. 11, 2002

(54) MAILING FORM FOR NON-IMPACT PRINTING

(75) Inventor: Warren M. Fabel, Delray Beach, FL (US)

(73) Assignee: Laser Substrates, Inc, Boca Raton, FL (US)

( * ) Notice: Subject to any disclaimer, the term of this patent is extended or adjusted under 35 U.S.C. 154(b) by 0 days.

(21) Appl. No.: 09/549,739

(22) Filed: Apr. 14, 2000

Related U.S. Application Data

(63) Continuation-in-part of application No. 09/243,003, filed on Feb. 2, 1999, now Pat. No. 6,173,888, which is a continuation-in-part of application No. 08/480,161, filed on Jun. 7, 1995, now Pat. No. 5,865,717, application No. 09/549,739, which is a continuation-in-part of application No. 09/132,036, filed on Aug. 11, 1998, now Pat. No. 6,155,476, which is a continuation-in-part of application No. 08/434,416, filed on May 3, 1995, now Pat. No. 5,791,553, application No. 09/549,739, which is a continuation-in-part of application No. 09/361,660, filed on Jul. 27, 1999, now abandoned, which is a continuation-in-part of application No. 08/349,062, filed on Dec. 1, 1994, now Pat. No. 5,954,431, application No. 09/549,739, which is a continuation-in-part of application No. 09/293,633, filed on Apr. 15, 1999, now Pat. No. 6,217,079, which is a continuation-in-part of application No. 08/377,126, filed on Jan. 23, 1995, now Pat. No. 5,899,504, application No. 09/549,739, which is a continuation-in-part of application No. 09/488,067, filed on Jan. 19, 2000, which is a continuation-in-part of application No. 09/179,224, filed on Oct. 27, 1998, now Pat. No. 6,095,919, application No. 09/549,739, which is a continuation-in-part of application No. 09/102,852, filed on Jun. 23, 1998, which is a continuation-in-part of application No. 08/049,946, filed on Apr. 20, 1993, now Pat. No. 5,836,622.

(51) Int. Cl.[7] ..... B65D 27/06; B65D 27/04
(52) U.S. Cl. ..... 229/303; 229/92.3; 229/304
(58) Field of Search ..... 229/92.3, 300, 229/301, 303, 304, 305

(56) References Cited

U.S. PATENT DOCUMENTS

| | | | | | |
|---|---|---|---|---|---|
| 4,102,489 | A | * | 7/1978 | Lucas | 229/304 |
| 4,706,877 | A | * | 11/1987 | Jenkins | 229/304 |
| 4,809,906 | A | * | 3/1989 | Lombardo | 229/304 |
| 4,898,323 | A | * | 2/1990 | Chen et al. | 229/92.3 |
| 5,238,182 | A | * | 8/1993 | Loch | 229/304 |
| 5,375,763 | A | * | 12/1994 | Sauerwine | 229/303 |
| 5,458,273 | A | * | 10/1995 | Schubert et al. | 229/304 |
| 5,607,738 | A | * | 3/1997 | Bishop | 229/92.3 X |
| 6,027,014 | A | * | 2/2000 | Cochran | 229/301 X |

* cited by examiner

*Primary Examiner*—Jes F. Pascua
(74) *Attorney, Agent, or Firm*—Ted W. Whitlock

(57) ABSTRACT

A mailing form, including an upper sheet of material adhesively fastened to a lower sheet, is configured for the printing of information on a single side during passage of the form through a non-impact printer. At a first end of the form, the upper and lower sheets are fastened together permanently, forming a pocket to be used as a return envelope. The portion of the upper sheet which extends away from this pocket is divided into an inner flap, on which information is printed, and an outer flap, which is temporarily fastened to the lower sheet in order to protect an adhesive pattern during the printing process. After the printing process, the outer flap is removed and discarded, the inner flap is folded along lines provided for folding, and the lower sheet is folded on itself to enclose the inner flap. As the adhesive pattern holds the lower sheet shut in this position, address and return address information printed on the inner flap is visible through apertures in the lower sheet, which forms an envelope. After receiving this envelope, the recipient separates the pocket forming a return envelope from the rest of the materials. A part of the inner flap may be returned in this return envelope, together with a check or other remittance as desired. The address and return address has been printed on this envelope during the printing step. Before the return envelope is mailed it is sealed using a flap with remoistenable adhesive.

12 Claims, 28 Drawing Sheets

MAILING FORM FOR NON-IMPACT PRINTING

CROSS-REFERENCE TO RELATED APPLICATIONS

This is a continuation-in-part of U.S. Patents/Patent Applications:

Ser. No. 09/243,003 filed Feb. 2, 1999 now U.S. Pat. No. 6,173,888, issued Jan, 16, 2001, which is a continuation-in part of Ser. No. 08/480,161 filed Jun. 7, 1995 now U.S. Pat. No. 5,865,717, issued Feb. 2, 1999;

Ser. No. 09/132,036 filed Aug. 11, 1998 now U.S. Pat. No. 6,155,476 issued Dec. 5, 2000, which is a continuation-in-part of Ser. No. 08/434,416 filed May 3, 1995 now U.S. Pat. No. 5,791,553 issued Aug. 11, 1998;

Ser. No. 09/361,660, filed Jul. 27, 1999, now abandoned which is a continuation-in-part of Ser. No. 08/349,062 filed Dec. 1, 1994 now U.S. Pat. No. 5,954,431 issued Sep. 21, 1999;

Ser. No. 09/293,633, filed Apr. 15, 1999 now U.S. Pat. No. 6,217,079 issued Apr. 17, 2001, which is a continuation-in-part of Ser. No. 08/377,126 filed Jan. 23, 1995 now U.S. Pat. No. 5,899,504 issued May 4, 1999;

Ser. No. 09/488,067, filed Jan. 19, 2000, which is a continuation-in-part of Ser. No. 09/179,224 filed Oct. 27, 1998 now U.S. Pat. No. 6,095,919 issued Aug. 1, 2000; and Ser. No. 09/102,852, filed Jun. 23, 1998, which is a continuation-in-part of U.S. patent application Ser. No. 08/049,946, filed Apr. 20, 1993, and now U.S. Pat. No. 5,836,622 issued Nov. 17, 1998;

each of which are hereby incorporated by reference.

FIELD OF THE INVENTION

This invention is related to mailing forms, and more particularly, to mailing forms which can be folded to form a combination correspondence portion, initial mailing envelope portion, and return or remittance envelope portion, wherein variable information, e.g., address information, for each of these portions can be printed by a single pass through a non-impact printer.

BACKGROUND OF THE INVENTION

Non-impact printers, such as laser or ink jet printers, are being increasingly used to provide a fast, economical, and convenient method of printing data developed within computer systems and stored in databases. An important example of this kind of data is found in the accounts receivable data of both large and small organizations. In most organizations, preparing and distributing monthly statements represents a significant effort, as account data is printed and distributed in envelopes.

Many invoices, monthly statements, renewal notices, questionnaires and the like arrive in a single envelope together with a number of other printed documents. At a typical minimum level, a return envelope and a response document are included with the mailing. While responses may all be returned to a central location, it is often desirable to provide a number of different locations, or box numbers, to which responses for various different mailings are sent. In this way, an initial sorting step can be avoided.

Multi-part forms, including envelopes in which statements are sent, together with the statements themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that externally applied printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially with small organizations, the percentage of organizations having the impact printers necessary to use such multi-part forms is decreasing. Furthermore, such forms often must be processed through automatic folding/sealing machines to be used in a practical manner. Such automatic folding machines are other examples of equipment not available to many small organizations. In addition, pouch or envelope products using a high speed plow-folder for production fold over a "shoe," which, when contacted by glue, can cause web breaks and contamination of production equipment or other parts of the form. Therefore, what is needed is a mailing form configured for use with non-impact printers and which can be easily prepared with or without the use of a folding machine.

Mailing forms heretofore developed for use in non-impact printers typically require that some information be printed on each side of the form if a return envelope is to be constructed from the form. Because of practical considerations, dual side printing generally means that fixed data, which is the same for all of the forms being printed, must be printed on one side while variable data, which is generally specific for each form being printed, is printed on the other side. For example, the front of the return envelope is printed with fixed data on one side of the form. In this way, the customer returning the return envelope is required to fill out his address. This compromise may present an inconvenience for the organization originally sending the mailing forms and for the customer as well. If the address of the organization must be printed as part of the fixed information on the return envelope, a special box number related to the particular form cannot be used.

Yet another disadvantage of previously produced products is their incompatability with non-impact, e.g., laser, printers. Products produced to be printed on non-impact printers are less tolerant of multi-ply substrates which are pre-laminated together and thereby become more rigid. This can create jamming of the printer or feeder mechanism when the rigid laminates are forced around small diameter rollers in the paper path of the printer.

A further problem with sheet fed laser mailers is that to create a two-way mailer usually requires an overly long product and also a duplex printer to print the return address on the remittance envelope.

What is also needed is a compact, two-way mailer which can be processed on a folder/sealer machine which is common in the forms industry. The two-way mailer must be printable on a simplex printer and allow for addressing both the outgoing and return envelopes in a single pass through the printer. It must also have the flexibility to easily wrap around the rollers in the printer paper path during the printing process. Further, it must be capable of efficient manufacture as a web product.

A number of different types of forms include flaps or pockets provided in a closed configuration which must be opened at a later time. See, for example, U.S. Pat. No. 5,633,071, issued to Moore Business Forms, Inc. However, this patent describes a form having the disadvantage of not providing a return envelope, nor providing for Information Based Indicia (IBI) or showing of a Face Indicating mark (FIM) per the requirements of the United States Postal Service (USPS). Various means are employed to make a portion of the form tear open in a preferred manner. For example, a perforated or die-cut sheet may be used in this way. Alternatively or additionally, a number of parallel glass fibers (fiberglass) may be provided to give a particular strip of material the strength needed for easy removal without breaking apart. A problem with this approach is that the glass fibers lie only in a straight line, so that the material to be removed must be a straight strip. What is needed is a reinforcing coating which can be applied to material which is not straight, allowing its removal without breaking up.

Thus, what is needed is a mailing form that can be used to produce an initial mailer envelope, a return envelope, and a correspondence portion, e.g., a billing statement, by printing on one side only of the form. A mailing form providing these advantages that are absent from the currently available forms, including the provision of a return envelope, and areas for IBI and FIM indicia, is needed in the art and is provided by the subject invention as described herein.

SUMMARY OF THE INVENTION

In accordance with one aspect of the invention, there is provided a mailing form including a lower sheet of material having first and second ends, with a first transverse folding line between the first and second ends, and an upper sheet of material overlying and aligned with the lower sheet of material. The upper sheet of material includes a first upper sheet portion, an outer flap, and an inner flap, the outer flap and the inner flap being separated by a first cut line, and the outer flap extending to the second end of the lower sheet. A first adhesive system forms a bond between the first end and an adjacent surface of the first upper sheet portion and a second adhesive system forming a temporary bond between the second end and the outer flap. The second adhesive system includes an adhesive permanently bonded to the lower sheet, the second adhesive system being of a type which forms a permanent bond with another sheet of material after separation from the outer flap.

In another aspect of the subject invention, the inner flap comprises a postal indicia portion which can be folded to meet the top edge of the outgoing envelope in order to automatically position and Indicia Based Identification (IBI) code in proper position as required by the US Postal Service (USPS). In addition, a Face Identification Mark (FIM) is properly positioned , without skewing, no more than one-eighth inch from that top edge, and preferably flush with that edge. This FIM positioning is also required by the USPS.

In yet another embodiment of the subject invention, the form comprises a plurality of plies, typically two plies, which can be configured to form a correspondence portion, e.g., a letter or billing statement, which is folded to form an initial, or mailer, envelope portion, and further comprises an integral return envelope used, for example, by the receiver of the correspondence to return materials, information, correspondence, or payment. Advantageously, all variable information for each of these portions are printable by a single pass through a simplex, non-impact printer device. Additional pages of the correspondence portion can be pre-printed and included within this embodiment to provide additional space for further correspondence information.

BRIEF DESCRIPTION OF THE DRAWINGS

One preferred embodiment of the subject invention is hereafter described with specific reference being made to the following figures:

FIGS. 16–28B illustrate yet another embodiment of the subject invention which comprises a substantially two-ply correspondence form foldable into a mailer envelope portion having integral therewith a return envelope which is formed by further folding of one of the two plies, wherein:

FIG. 16 is a plan view of a front (outer) face of a top ply of the correspondence/mailer/return envelope embodiment, in extended configuration, using an 8½×11 inch or A4 size sheet foldable along the horizontal midline, according to the subject invention.

FIG. 17 is a plan view of a back (inner) face of a top ply of the correspondence/mailer/return envelope embodiment, in extended configuration, according to the subject invention.

FIG. 19 is, in extended configuration, a front (inner) face of a bottom ply of the correspondence/mailer/return envelope embodiment, in extended configuration, according to the subject invention.

FIG. 20 is the front face of the bottom ply illustrated in FIG. 19 after folding along a first fold line, thereby forming the return envelope pouch.

FIG. 21 is the front face of the bottom ply illustrated in FIGS. 19 and 20 after folding along a second fold line, thereby folding the return envelope portion to be contained between the top and bottom plies.

FIG. 22 is an exploded view of the top and bottom plies as superimposed and adhered to one another to form the form according to this embodiment of the subject invention.

FIG. 23 is a front plan view of the outer face of the two ply form having variable information printed thereon after a single pass through a simplex non-impact printer.

FIG. 24 is a plan view of the form shown in FIG. 23 in folded configuration to form a mailer.

FIG. 25 is a plan view of the folded mailer shown in FIG. 24, illustrating the removable tear-off strips which are removed to open the mailer by the recipient.

FIG. 26 is a plan view of the outer face of the top ply of the two-ply mailer after having the removable tear-off strips removed and being opened by the recipient.

FIG. 27 is a plan view of the bottom face of the two-ply mailer, after removal of the top ply, and illustrating the return envelope portion which is now physically separated from the bottom ply by previous removal of the tear-off strips.

FIG. 28B shows a further variation of the PC Postage window of the mailer envelope whereby a solid, L-shaped, border is printed on two sides of the window as an alternative to a bar-coded face identification mark (FIM).

DETAILED DESCRIPTION

Figure 1:
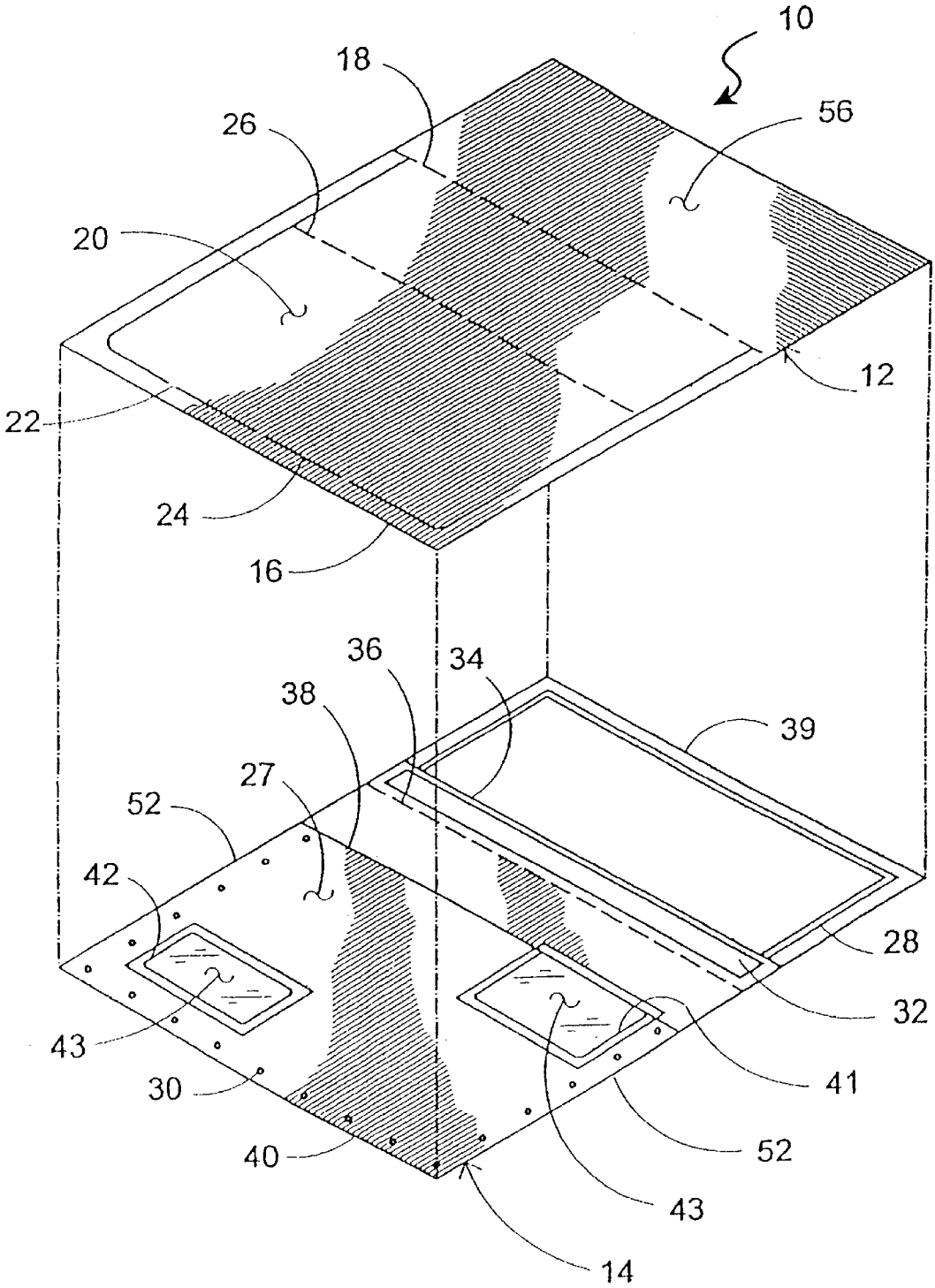
FIG. 1 is an exploded isometric view of a mailing form made in accordance with the present invention, showing the two paper sheets joined to make the form in an exploded relationship.

FIG. 1 is an exploded isometric view of a mailing form 10, which includes an upper sheet 12 and a lower sheet 14. It is to be understood herein that the words "upper" and "lower" imply directions which are arbitrarily chosen merely to establish a consistent way of describing the components and features of this form. Sheets 12 and 14 may be composed of any of a number of tic materials and composites which are used as paper substitutes.

Mailing form 10 is particularly configured to facilitate subsequent processing through a typical non-impact printer, such as a laser printer or an ink jet printer commonly found in both small and large offices and computer rooms. Form 10 is designed so that all necessary information is to be printed on a single side of form 10; more specifically, all printing occurs on the upper side 56 of upper sheet 12. Where form 10 is to be used with a laser printer, the choice of materials and configurations is made to facilitate the movement of the form 10 through the hot pressure rolls of a non-impact printer fuser without damage to either the form or the fuser. While mailing form 10 is provided for printing in the shape of a single sheet of paper, which is preferably a standard size, such as 8½ inches wide by 11 inches long, after printing it can be folded into an initial mailer envelope containing a statement to be sent to a customer. After this initial mailer envelope is received and opened, the customer can return a part of the form, together with a check, if required, in a return envelope also formed from a portion of mailing form 10.

Upper sheet 12 includes a removable "U" shaped outer strip 16, extending around a periphery of sheet 12 from a first perforated line 18 extending entirely across the sheet 12. Outer strip 16 is preferably joined to the adjacent inner flap 20 of upper sheet 12 by a means of a number of ties 22 extending between slits 24 through the material of the sheet 12. A second perforated line 26 extends across inner flap 20.

Lower sheet 14 includes, on an upper (or inner) surface 27, adhesive features which are used in the process of jointing the two sheets 12 and 14. A "U" shaped, pressure sensitive adhesive strip 28 extends around the periphery of an end of lower sheet 14, which is fastened to an end of upper sheet 12 opposite the end at which "U" shaped strip 16 is formed. A number of pressure sensitive adhesive dots 30 are formed in a "U" shaped pattern beneath to strip 16. Both adhesive strip 28 and adhesive dots 30 are preferably moved inward, away from the edges of the sheet 14, so that subsequent passage of the mailing form 10 through the fuser of a non-impact printer cannot squeeze adhesive material outward to or past the edges of form 10. The reason, of course, is that adhesive squeezed out from form 10 could otherwise become a damaging contaminant on the surface of the fuser rollers.

Lower sheet 14 also includes a number of features which are subsequently used to form envelopes. A remoistenable adhesive layer 32 extends between a first scored line 34 and a perforated line 36. It should be understood that a scored line is weakened to facilitate folding at a preferred location and a perforated line includes voids to facilitate either folding or separation by tearing. Various well-known form manufacturing processes can be used to form score lines and perforated lines as shown. For example, a perforated line formed by die cutting can be used to locate a fold as well as to locate a line of separation. Lower sheet 14 also includes a second scored line 38 extending transversely across the sheet 14 midway between a first end 39 and a second end 40 of lower sheet 14. Lower sheet 14 also includes at least a first aperture 41 and a second aperture 42, each of which is covered by a transparent sheet 43, fastened in place using a permanent adhesive. Each transparent sheet 43 is preferably composed of a heat resistant material, such as cellulose, which will not suffer excessive dimensional changes and wrinkling as mailing form 10 is subsequently passed through the hot fuser rolls of a typical non-impact printer.

Figure 2:
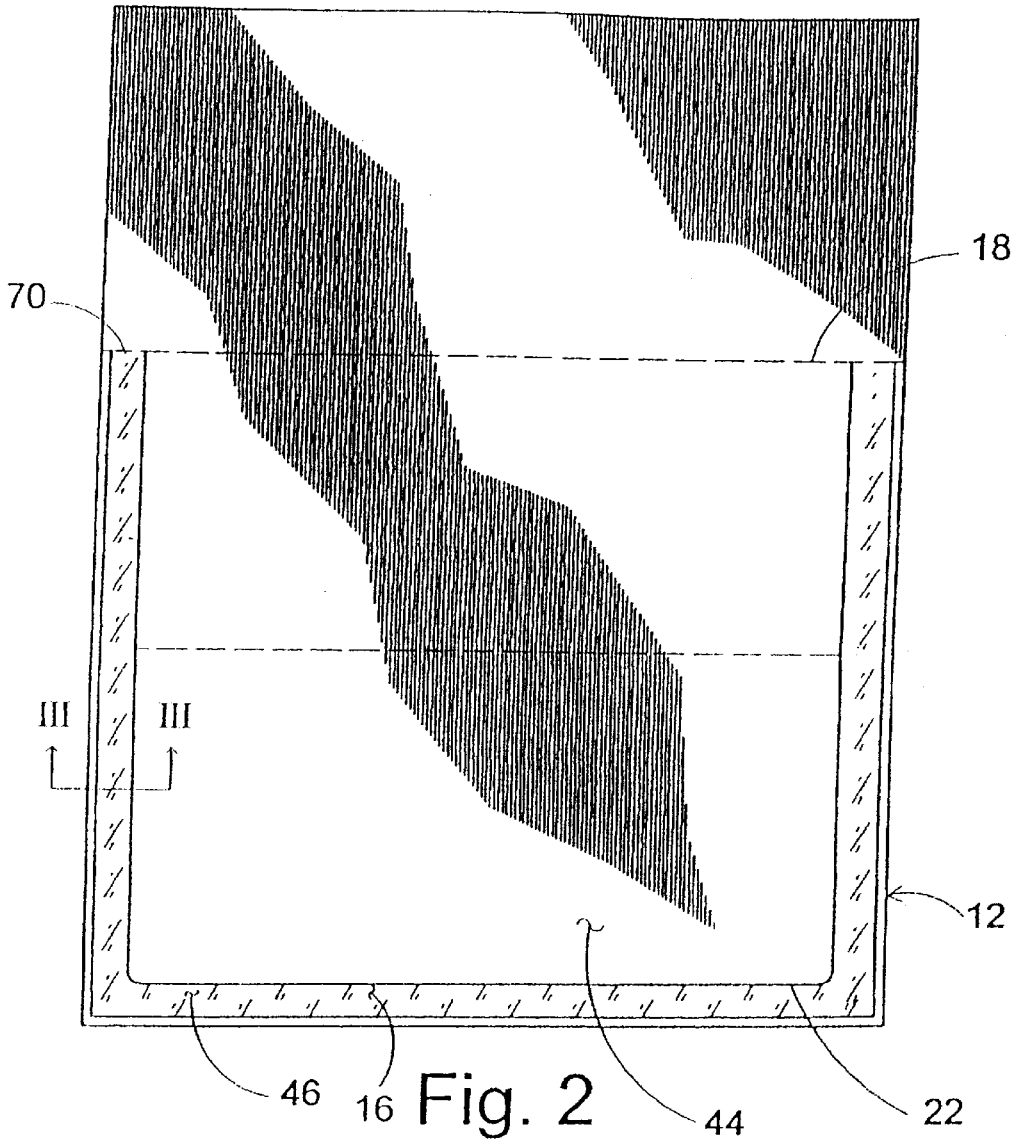
FIG. 2 is an underneath plan view of the upper paper sheet of the mailing form of FIG. 1.

FIG. 2 is an underneath plan view of upper sheet 12, showing the under (inner) surface 44 thereof. A reinforcing coating 46 is applied to the inner surface of "U" shaped outer strip 16 to facilitate the removal of strip 16, as a single piece, as described hereafter.

Figure 3:
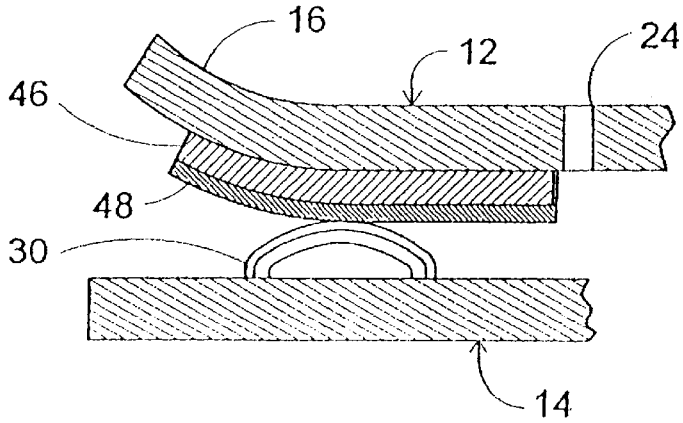
FIG. 3 is a cross-sectional elevational view of an outer flap portion of the upper paper sheet of FIG. 2, taken across lines III—III in FIG. 2, and being pulled away from an underlying lower paper sheet.

FIG. 3 is a cross-sectional elevation of outer strip 16, taken as indicated by section lines III—III in FIG. 2, as strip 16 is pulled away from underlying lower sheet 14. Reinforcing coating 46 is preferably composed of a coatable substance, such as varnish, having chopped fibers suspended therein. The chopped fibers may individually be 1/16 to 3/16 of an inch long and may be, for example, made from either fiberglass or from a natural material, such as cotton. An advantage of using a natural material, such as cotton, is that the biodegradability of the product after its disposal is enhanced. In general, various types of material and synthetic fibers typically used in the production of textiles may be chopped to length for use as the filler. To speed the production of mailing form 10, the varnish used in reinforcing coating 46 is preferably of a type which is cured or "set" by means of the application of ultraviolet light. Further, by suspending the chopped fibers in the varnish, the additional steps of applying the fibers to the coated varnish after it is spread on the sheet is eliminated. The reinforcing coating 46 may be used to reinforce any portion of a sheet of paper, such as binder holes, as well as used to reinforce a removable portion, such as strip 16.

In the assembly of upper sheet 12 and lower sheet 14 to form mailing form 10, strip 16 is brought together with adhesive dots 30. After the subsequent printing process, strip 16 is removed and discarded. To facilitate separation of strip 16 from adhesive dots 30 at this point, a silicon release coating 48 is preferably coated on the exposed surface of reinforcing coating 46 during the production of upper sheet 12.

Referring again to FIG. 1, mailing form 10 is formed by aligning upper sheet 12 with lower sheet 14 and by pressing these sheets together. Pressure sensitive adhesive strip 28 holds sheets 12 and 14 together along first end 39 and partly along both longitudinal sides 52, while adhesive dots 30 hold sheets 12 and 14 together along second end 40 and partly along both sides 52. In this way, the sheets 12 and 14 are held together for processing through a non-impact printer. After this assembly process, the form 10 is ready for the printing of information on upper surface 56.

Figure 4:
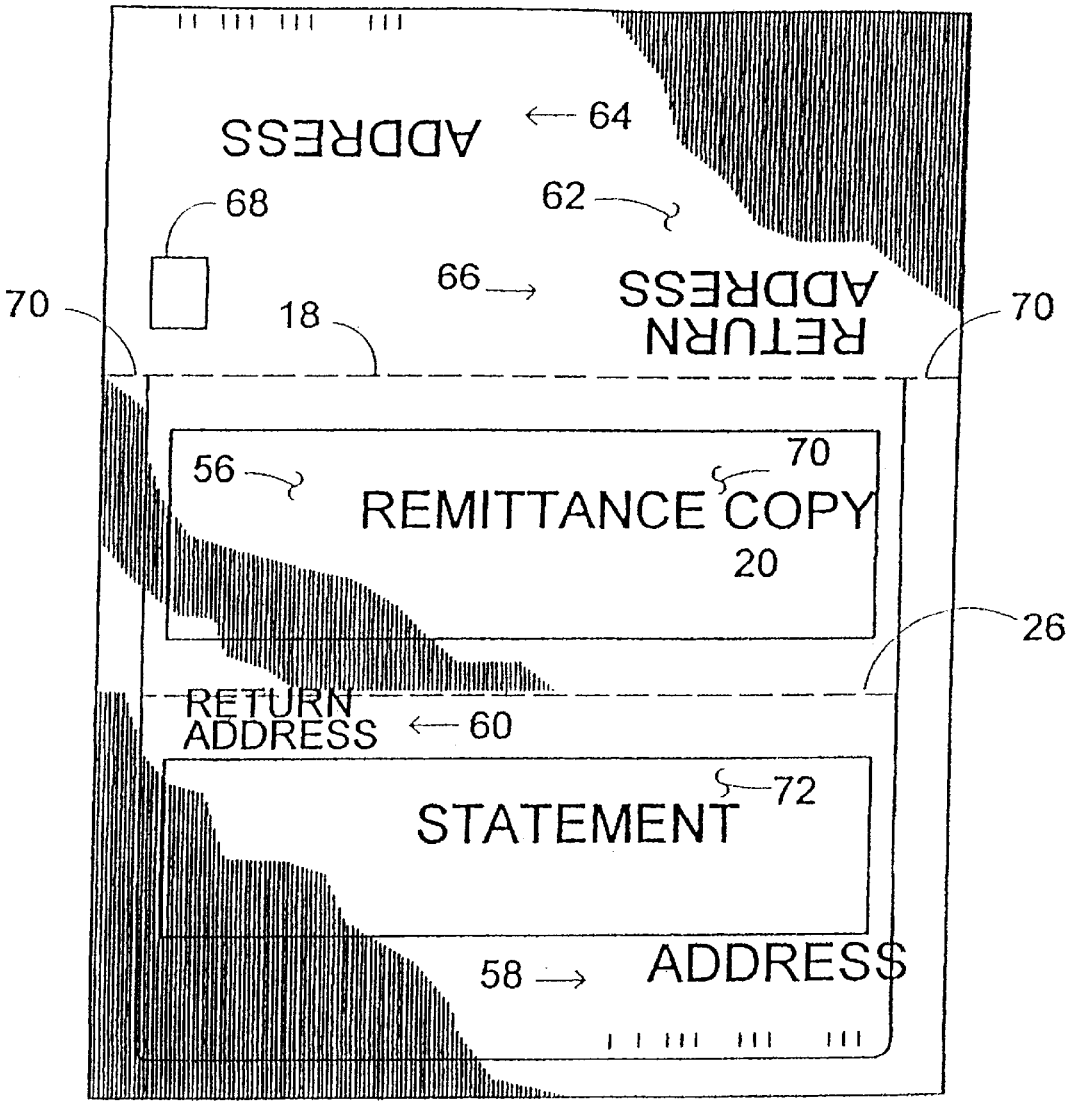
FIG. 4 is a plan view of the mailing form of FIG. 1 after a printing step.

FIG. 4 is a plan view of mailing form 10 after exemplary information is printed on upper surface 56. This information includes address and return address information for both an initial mailer envelope configuration, in which form 10 is mailed to the customer, and for a return envelope configuration, in which the customer is expected to return a remittance portion of the form 10, together with additional material, if necessary, such as a check. Specifically, the address of the customer (or other individual or organization to which form 10 is initially sent) is printed in a first address field 58, and the return address of the organization initially sending the form is printed in a first return address field 60.

An end portion 62 of mailing form 10 is eventually used as a return envelope. Thus, the address of the organization expecting to receive the return envelope is printed in the second address field 64, and the address of the customer is printed in second return address field 66. Other envelope information, such as a stamp locating graphic 68, may also be printed. The envelope information on portion 62 is preferably printed in an inverted orientation relative to the other information printed on mailing form 10. In order to expedite the handling of materials through the postal system, a POSTNET bar code may be printed within each address field 58 and 64.

The information to be sent to the customer by means of mailing form 10 is printed on inner flap 20, which is divided into a first flap portion 70 and a second flap portion 72 by perforated line 26. All of first flap portion 70 can be used for such information. The envelope addressing information contained in fields 58 and 60 are arranged to align with apertures 41 and 42 following the folding steps described hereafter with respect to FIGS. 5 and 6. Therefore, the remaining area of second flap portion 72 can be used for informational content, which will be exposed only after the first envelope to be made using form 10 is opened. For example, the informational content of a statement may be printed on second flap portion 72, while a remittance copy to be returned by the customer may be printed on first flap portion 70.

Figure 5:
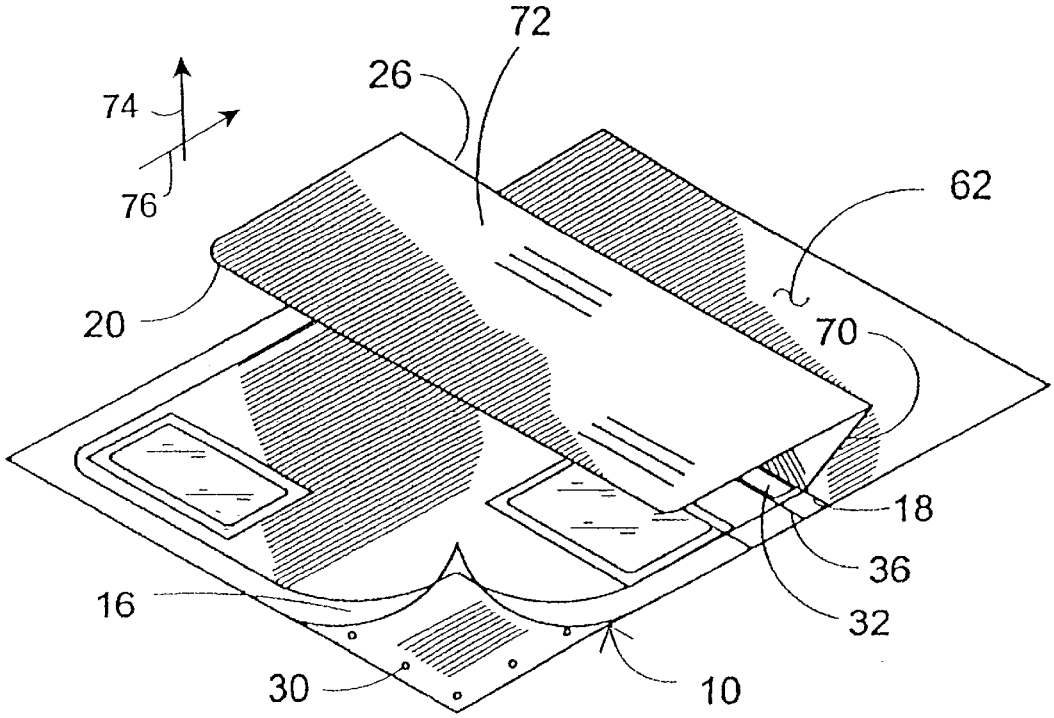
FIG. 5 is an isometric view of the mailing form of FIG. 1 during a first folding step, which occurs after the printing step.
Figure 6:
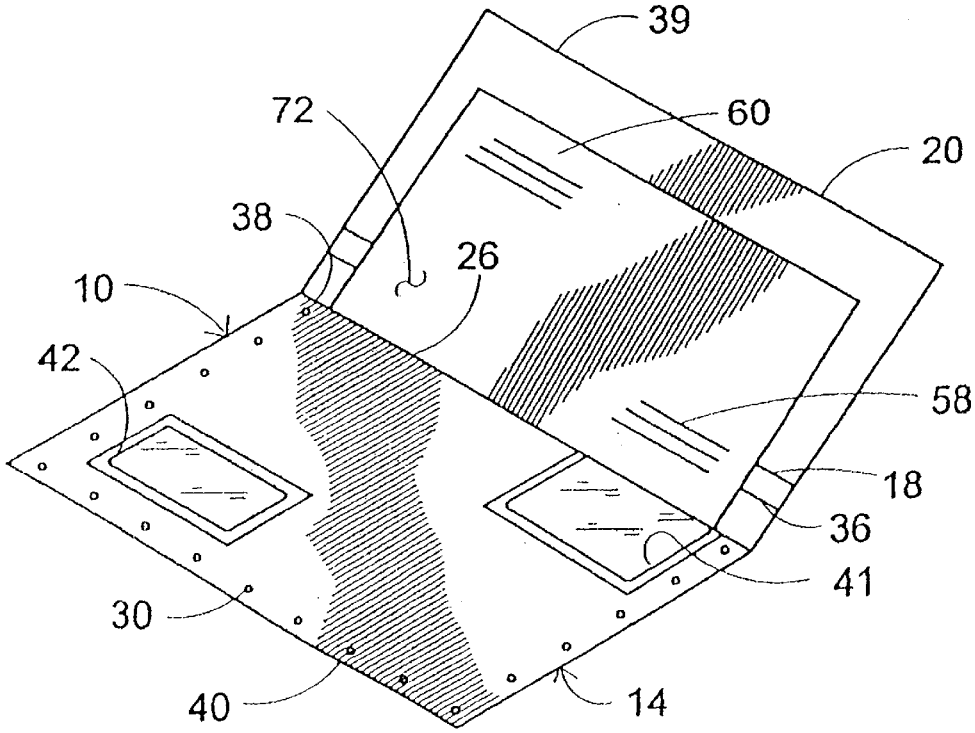
FIG. 6 is an isometric view of the mailing form of FIG. 1 during a second folding step, which occurs after the first folding step of FIG. 5.

Referring to FIGS. 5 and 6, outer strip 16 holds inner flap 20 in place and maintains a cover over adhesive dots 30 as mailing form 10 is fed through the printer during the printing process. After the printing process, inner flap 20 is pulled away from lower sheet 14, as ties 22 are torn apart, and outer strip 16 is separated and removed from the remainder of form 10. Reinforcing coating 46 facilitates the removal of outer strip 16 as a single piece, and the silicone release agent applied to the exposed surface of coating 46 allows strip 16 to be easily pulled away from adhesive dots 30, which are left in a condition ready for reuse. After outer strip 16 is removed, it is discarded.

More specifically, FIG. 5 shows an isometric view of mailing form 10 during the performance of a first folding step after the printing operation. First, inner flap 20 is released and folded along lines 18 and 26. Specifically, inner flap 20 is folded upward, in the direction of arrow 74, and longitudinally, in the direction of arrow 76, with bending occurring along perforated lines 18 and 26. After this folding step is completed, second flap portion 72 is upwardly exposed, while first flap portion 70 (shown in FIG. 4) is folded downward against end portion 62. Thereafter, outer strip 16 is removed, and adhesive dots 30 are upwardly exposed.

FIG. 6 shows an isometric view of mailing form 10 during the performance of a second folding step, which occurs after the first folding step of FIG. 5 and removal of outer strip 16. The combination of portion 62 and folded portions 70 and 72 and that portion of lower sheet 14 against which portions 70 and 72 are folded along scored line 38 to enclose inner flap 20 as the ends 39 and 40 of lower sheet 14 are brought together. When this folding step is completed, form 10 is closed, and sealing occurs as pressure sensitive adhesive dots 30 are compressed against end portion 62. As noted above, address field 58 is exposed through aperture 41 and return address field 60 is exposed through aperture 42. At this point, mailing form 10 is converted into an envelope, which after the application of postage, is ready for mailing to the customer.

Figure 7:
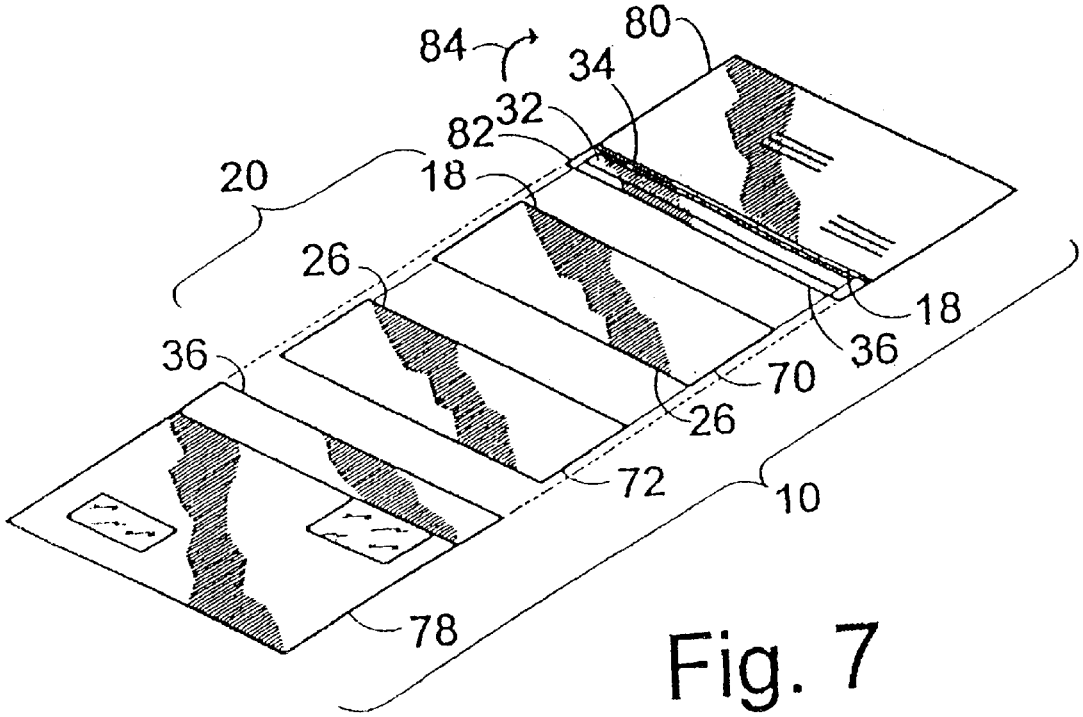
FIG. 7 is an isometric view of the mailing form of FIG. 1 after receipt, opening, and separation.

Referring now to FIG. 7, after the customer receives form 10 as folded for mailing, the customer first opens the envelope by peeling upper sheet 12 down, thereby breaking the seal formed by adhesive dots 30. With the seal broken, form 10 is snapped or pulled apart, thereby causing perforations 36 to separate and free scrap portion 78, and inner flap 20 is exposed. Next, inner flap 20 is pulled back into an essentially flat, unfolded condition, fully exposing the information printed on both second flap portion 72 and first flap portion 70 (shown in FIG. 4). Next, inner flap 20 is detached from the remainder of form 10 along perforated line 18, and first flap portion 70 and second flap portion 72 are separated from one another along perforated line 26. Inner flap 20 thus forms two separated documents, one of which may be statement 70 and the other of which may be remittance portion 72 to be returned by the customer within a return envelope 80, along with other materials as required, such as a remittance check.

FIG. 7 thus shows an isometric view of the materials of mailing form 10 after they have been separated into component parts by the customer. For convenience in FIG. 7, the edges formed by tearing a sheet apart along a perforated line are given the same reference number as the perforated line. The width of the pocket formed in return envelope 80, as determined by the distance between the portions of adhesive coating 28 extending along longitudinal sides 52 (as shown in FIG. 1) is preferably greater than six inches, thereby permitting the insertion of an ordinary consumer check without folding. As shown in the preferred embodiment where the two sheets 12 and 14 are standard sizes, such as 8½×11 inches or A4 size, the internal width of envelope 80 approximates 7½ inches, and in fact is made wider than remittance portion 72 so that it may also be inserted in envelope 80 without folding. The necessary materials are placed in return envelope 80, adhesive layer 32 is moistened, and flap portion 82 is folded in the direction of arrow 84 about scored line 34 to seal the return envelope.

A number of variations can be applied within the scope of the present invention. For example, as shown in FIG. 4, the information in second address field 64 and second return address field 68 is printed in an inverted relationship with respect to other information printed on the mailing form 10. This is done to allow both the initial mailer envelope and the return envelope to open from the top, as most people are familiar with opening envelopes in this way. Alternatively, the printed information may be oriented in a common direction if either the initial mailer envelope or the return envelope is allowed to open from the bottom.

As shown in FIG. 7, sealing flap 82 of the return envelope 80 extends from the rear of this envelope, having been formed as a part of lower sheet 14 (shown in FIG. 1). Alternately, a sealing flap can be provided, extending from the front of the envelope, being formed as a part of upper sheet 12 (also shown in FIG. 1), at the expense of shortening first flap portion 70, reducing the space available for printed information.

These features described herein can also be incorporated into a second embodiment which includes additional modifications which can provide further advantages. For example, the second embodiment provides an addressee window which can accommodate printing of a POSTNET bar code, including the 14-digit bar code preferred by the USPS. In addition, this second embodiment can include a third window for showing a postage indicia area in compliance with USPS requirements, e.g., two-dimensional bar code (IBI) and a FIM mark correctly positioned ⅛ of an inch or less from a top edge of the envelope.

In accordance with this postage indicia window, the postage indicia, e.g., IBI bar code and FIM mark, can be printed on a modified second flap portion which can comprise a remittance portion and a postage indicia flap portion. The postage indicia portion of the second flap is preferably divided from the remittance copy by a die-cut or perforation along a longitudinal axis of the form. The longitudinal die-cut preferably provides a remittance copy of greater width than the postage indicia flap. In other words, the postage indicia flap is preferably about 30%–40% the width of the remittance copy, more preferably between about 33%–45%, and most preferably about 40% of the width of the remittance copy.

Advantageously, the postage indicia flap separates from the remittance copy along the longitudinal die-cut or perforation such that the postage indicia flap is not folded under the first flap with the remittance copy, but rather is positioned so that its top edge, opposite the edge connecting to the first flap, is flush with and contacts the top edge of the sheet forming the inner face of the outgoing envelope.

To provide for proper size and positioning of the postage indicia flap, a portion of the second flap is cut out between the top edge of the postage indicia flap and the intersecting tear line forming the upper edge of the envelope flap. The cut-out area is contiguous with the U-shaped strip bordering the first and second flaps so that the cut-out area is removed with the U-shaped strip.

In addition, the postage indicia flap is configured in a notched fashion at its top edge to provide for exposure of adhesive on the inner face of the outgoing envelope so that a bond can from and hold the inner faces of the outgoing envelope together when folded and formed.

Figure 8:
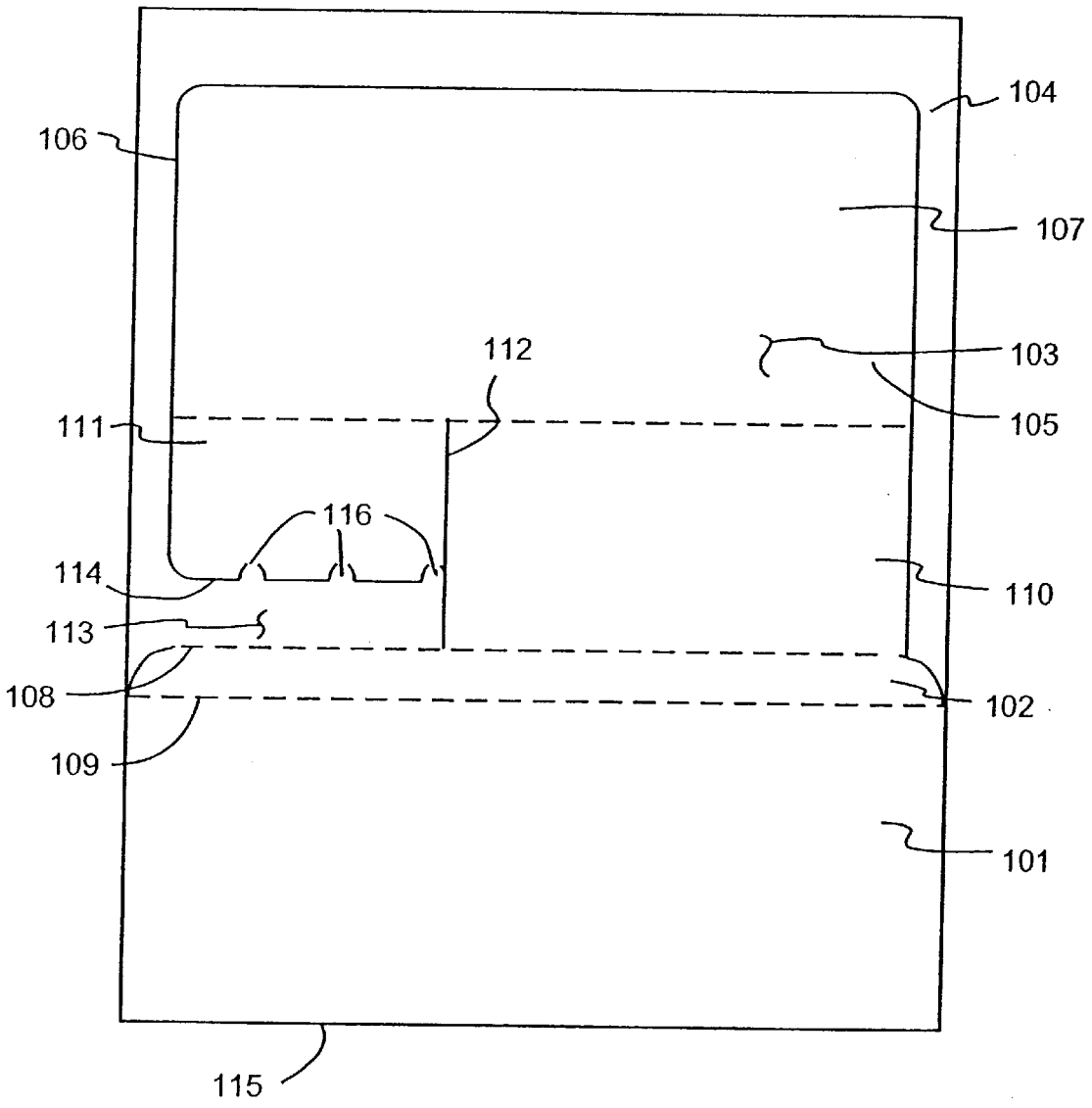
FIG. 8 is a plan view of a front (outer) face of the upper sheet of a second embodiment of the subject mailing form providing a flush FIM mark on the outgoing envelope.

The features of this second embodiment of the subject invention are further illustrated in the accompanying drawings, FIGS. 8–12. FIG. 8 shows an outer face of an upper sheet of the second embodiment of the mailing form 100 showing return envelope portion 101, with closure flap 102, a inner flap 103 which is bordered by a removable substantially U-shaped strip 104. Each of these features are analogous to those described for the first embodiment of the subject invention. In addition, this second embodiment includes perforations or die-cuts for separating the different portions of the form or for providing weakened fold lines for facilitating folding of the various sections in predetermined positions. For example, perforation 105 and die-cut 106 are provided to form a first flap portion 107. First flap portion 107 is thereby separable from the remainder of the form along perforation 105. Perforation 108 provides a separation line to separate return envelope portion 101 from the remainder of the form, and perforation 109 forming a fold line to facilitate folding of closure flap 102 over the return envelope portion 101.

However, in this second embodiment, inner flap 103 comprises first flap portion 107, second flap portion 110 which can be used as a remittance portion, and a postage indicia portion 111. Remittance portion 110 is divided from postage indicia portion 111 by die-cut line 112.

In addition, a cut-out area 113, which is contiguous with strip 104, and formed by die-cut 106, is provided at an outer edge 114 of postage indicia portion 111 so that the cut-out area 113 can be removed with strip 104 and leaving postage indicia portion 111 of an appropriate size (height) to contact and align with edge 115 of the form when remittance portion 110 is z-folded along fold line perforations 105 and 108 between envelope portion 101 and first flap portion 107. Postage indicia portion 111 is not folded at perforation fold line 105.

Further cut-out area 113 is configured to form notches 116 in postage indicia portion 111 so that adhesive disposed on the inner faces of the form are exposed and can bond the form into a folded outgoing envelope configuration. Die-cut 106 is provided with ties (small, uncut sections) in various positions to retain the integrity of the form when being printed.

Figure 9:
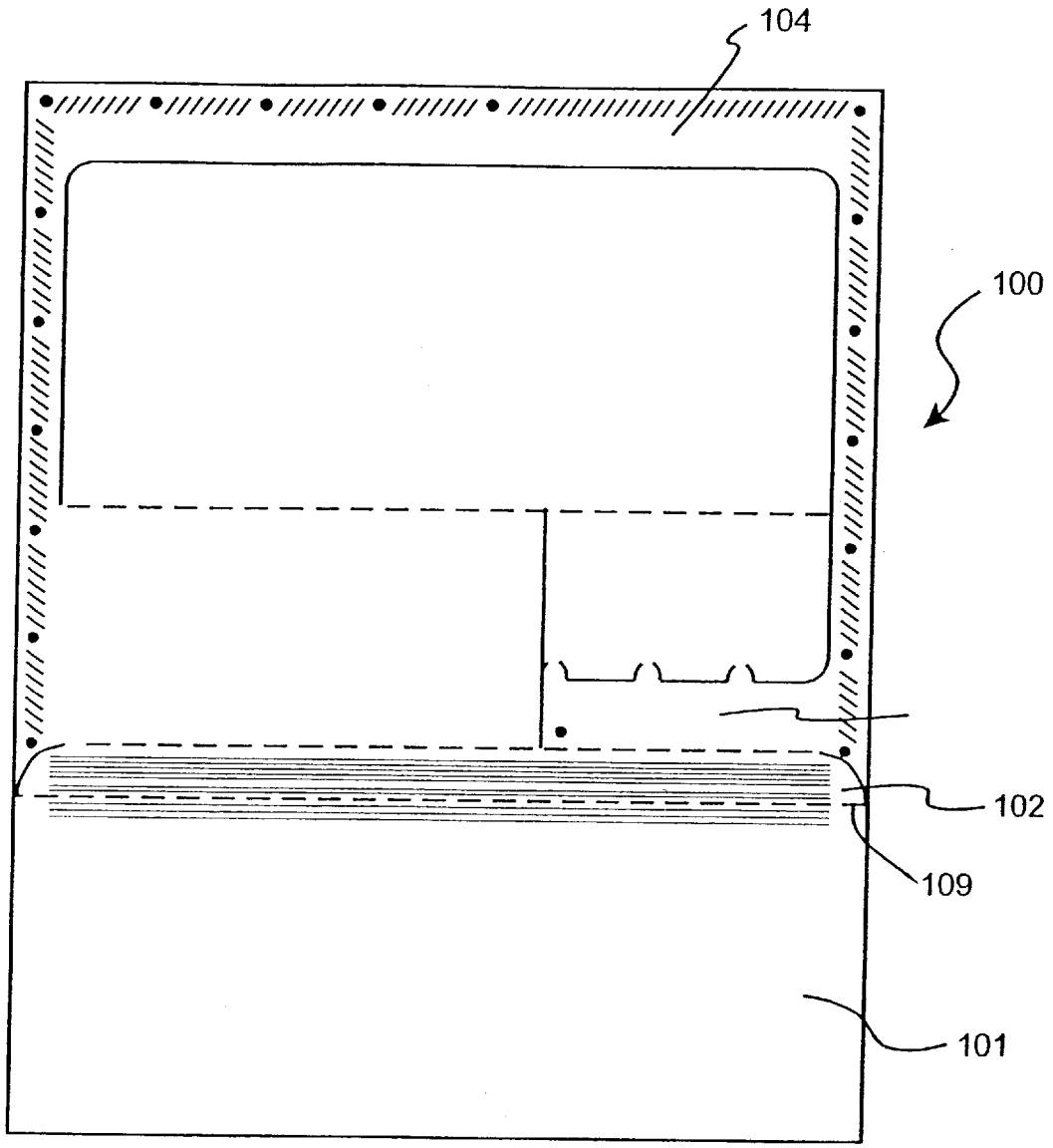
FIG. 9 is a plan view of a back (inner) face of the upper sheet of the second embodiment, illustrating placement of adhesive and adhesive-release materials.

FIG. 9 shows an inner face of the upper sheet (in mirror image) of form 100, illustrating the alternating adhesive (solid dots) and adhesive release (diagonal lines) disposed on strip 104 and on cut-out area 113. In addition, pressure sensitive adhesive (horizontal lines) is shown disposed on the contact areas of the return envelope portion 101 and closure flap 102.

Figure 10A:
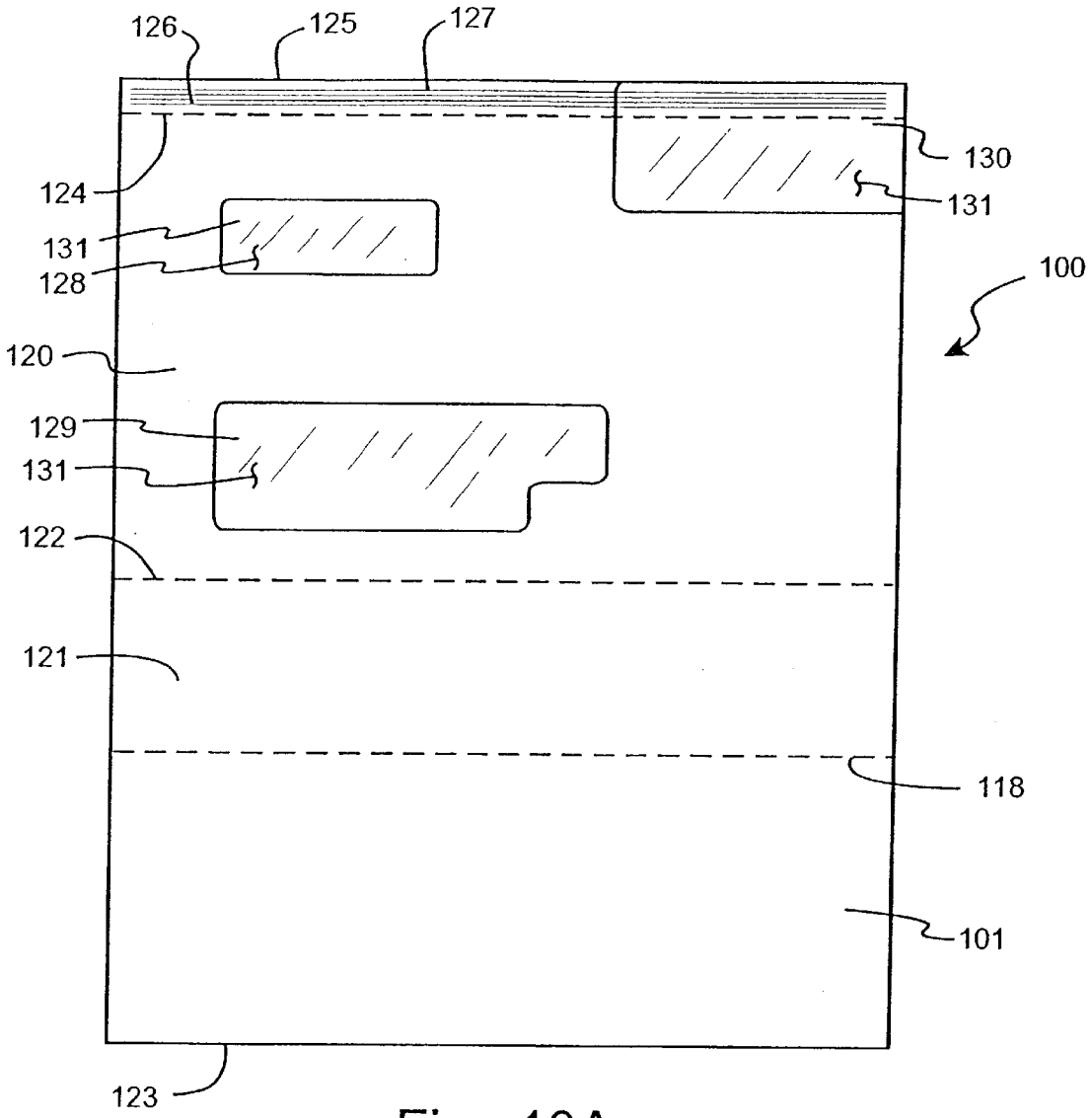
FIG. 10A shows a plan view of an outer face of the lower sheet of a second embodiment of the subject invention, illustrating transparent windows for addressee information, return address, and postage indicia.

FIG. 10A shows an outer face of a lower sheet of a second embodiment of mailing form 100. The lower sheet comprises return envelope portion 101, being separable from the remainder of the form along perforation 118. Perforation line 118 is aligned with the perforation 109 on the upper sheet. The lower sheet further comprises a top end portion 119 comprising a front face 120 of the outgoing envelope and a part of a back face portion 121 and return envelope 101. The envelope is formed by adhering the inner face of the lower sheet (which is exposed after strip 104 is removed) to the outer face of the upper sheet when the form is folded substantially midway along perforation fold line 122, in a direction into the page as shown. Adhesive material 123, preferably a commercially available pressure-sensitive adhesive, can be disposed between transverse perforation 124 and top edge 125 to contact and adhere a leading edge of the transparent sheet, integral with strip 127. Perforation 124 can be made through the outer transparent layer and the upper sheet so that strip 127 is removable from the remaining layers and providing a means for opening the outgoing envelope. In this case, a strip of adhesive material can be applied to the outer face of the return envelope, parallel to edge 115 shown in FIG. 8 such that it corresponds to adhesive strip 126 in FIG. 10A.

Figure 10B:
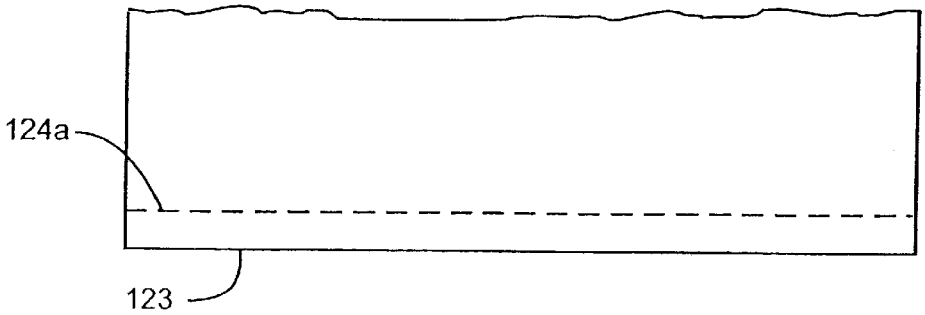
FIG. 10B shows a section of one end of the lower sheet of FIG. 10A, illustrating a variation thereof having a perforation across the bottom edge.

Alternatively, perforation 124 can be made through all the layers of the form, including a corresponding perforation 124*a* through all the layers at the bottom edge 123 of the form (see FIG. 10B). Thus, in the folded configuration of the outgoing envelope, perforations 124 and 124*a* align to provide a tear-away strip through all layers of the form. Removal of the tear-away strip comprised of all layers of the form provides a means for opening the outgoing envelope. It would be understood that the variation comprising a perforation 124*a* will require a slightly different placement of the adhesive at that end of the form. Specifically, the adhesive would correspond to a position inside the perforation 124*a* in order to maintain the integrity of the laminated form.

The front face 120 of the outgoing envelope further comprises cut-out area 128, 129, and 130 which are backed by a transparent sheet 131 to serve as windows for viewing information printed on the outer face of the upper sheet, which is folded to position the printed information for such viewing. Preferably, the transparent backing sheet is a single sheet wherein portions thereof are exposed through the cut-out window areas. Window area 128 provides for viewing of a return address; window area 129 provides for viewing of the addressee address; and window area 130 provides for viewing postage indicia. Each of these windows is formed and positioned to meet USPS requirements. For example, return address window 128 is preferably substantially rectangular and positioned toward the upper left-hand corner of the front face of the outgoing envelope. Addressee window 129 is preferably left of center on the envelope face and "stepped," having one portion wider than another. The narrower portion of the window is recessed so that USPS-printed information, e.g., an 11-digit delivery point POSTNET bar code, can be printed in its entirety on the envelope rather than the transparent window material, thereby preventing smearing of the printed information. Postage indicia window 130 is positioned such that it forms the top right-hand corner of the outgoing envelope. This allows positioning of a FIM mark, as required by the USPS, flush with, or at least within ⅛ inch of, the top edge 125 of the outgoing envelope.

Figure 11:
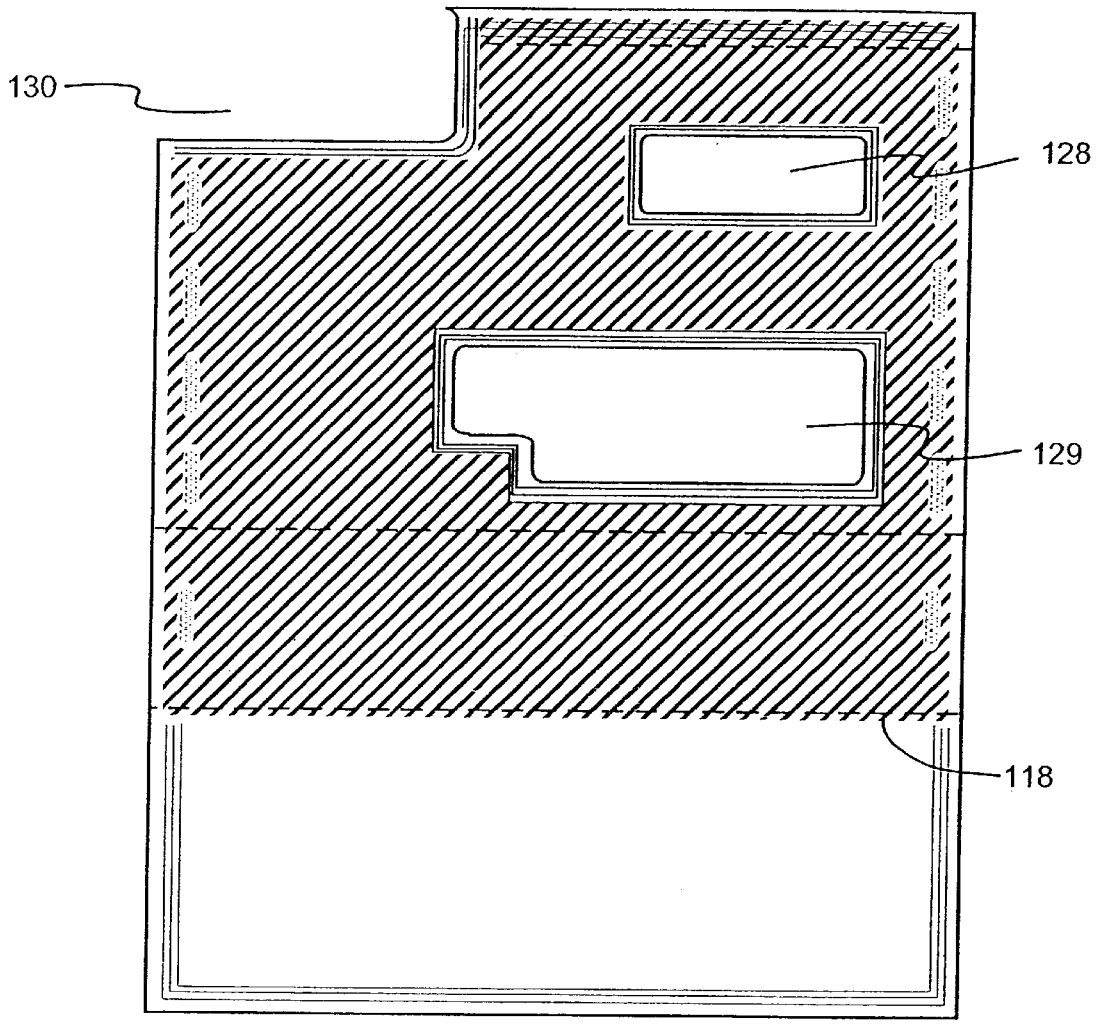
FIG. 11 shows a plan view of an inner face of the lower sheet of a second embodiment of the subject invention, illustrating adhesive and adhesive-release materials disposed thereon.

FIG. 11 shows an inner face of the lower sheet of the second embodiment of mailing form 100 to adhere a single transparent sheet (not shown) forming windows in cut-out areas 128, 129, and 130 and to reinforce the top edge 125 and perforation 118. In particular, FIG. 11 illustrates the placement of adhesive (striations) in relation to the various portions of the form. The adhesive is shown as striated and is preferably so disposed to reduce the amount of material used and to allow air to escape during the lamination process. In addition, the adhesive is preferably disposed so that a gap, preferably about 1/16 inch in width, is left along any edge of the underlying sheet to prevent oozing of the adhesive when heated, e.g., during a laser printing process. It would be understood that solid strips of adhesive or full coating of adhesive can also be used. The adhesive covers substantially the entire surface of the lower sheet from the top edge 125 to just below the perforation 118. Extending the adhesive past the perforation 118 provides for bonding of the transparent sheet thereto and reinforcement of that perforation.

To adhere the upper and lower sheets together in certain desired areas, alternating adhesive/adhesive release material is typically applied to the overlying transparent sheet and to the opposing face of the upper sheet so that adhesive matches to adhesive release material on opposing faces.

Figure 12A:
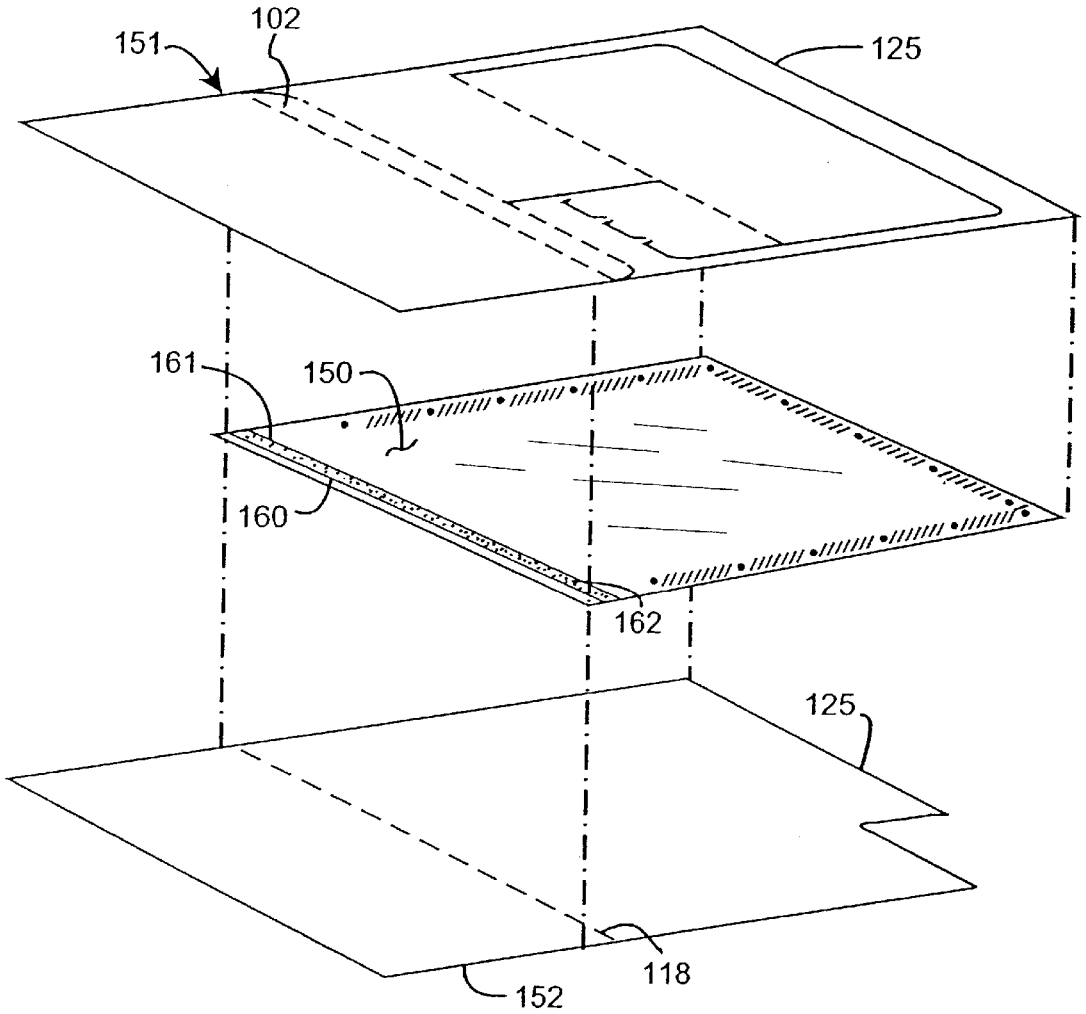
FIG. 12A shows a perspective view of a second embodiment of the subject mailer form, illustrating the transparent sheet disposed between the upper and lower sheets.

FIG. 12A shows the positioning of transparent layer 150 in relation to the upper and lower sheets 151 and 152, respectively. The transparent sheet is preferably rectangular, covering more than half to about two-thirds the surface area of the inner faces of the upper and lower sheets. As described above, the transparent sheet is preferably disposed such that it extends past perforation 118 of the lower sheet. Adhering the transparent sheet at this position on the lower sheet can advantageously provide reinforcement to perforation fold line 118. In addition, die-cuts 160 and 161 can be made through the transparent layer so that an adhesive protective strip 162 can be formed over the adhesive disposed on closure flap 102 and removed therefrom when sealing the return envelope. An adhesive release material (stippling) is correspondingly disposed on the face of the protective strip contacting the adhesive on closure flap 102 to facilitate the removal of the protective strip.

Figure 12B:
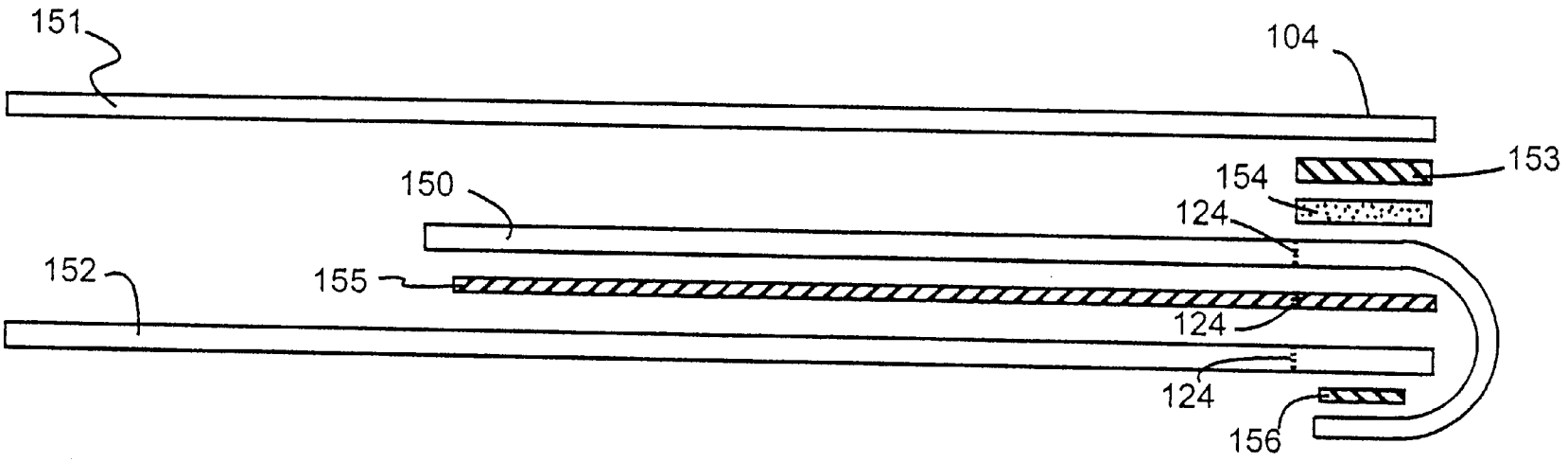
FIG. 12B shows a side view of the form of 12A illustrating the folded configuration of the transparent layer over the top edge of the lower sheet.

The transparent layer is shown to extend past the top edge 125 of the upper and lower sheets so that it can be folded over and made to contact the outer face of the lower sheet. The transparent layer preferably extends past the edge of the upper and lower sheers so that a strip approximately 3/16 inches overlaps onto the outer face of the lower sheet. This overlap of the transparent sheet is illustrated in FIG. 12B, which is a side view (not to scale) showing upper sheet 151, first adhesive layer 153, and adhesive layer 154 or releasing strip 104, transparent sheet 150, second adhesive layer 155 for bonding the transparent sheet to the inner face of the lower sheet, lower sheet 152, and third adhesive layer 155 for bonding the overlapped portion of the transparent sheet to the outer face of the lower sheet.

Figure 13:
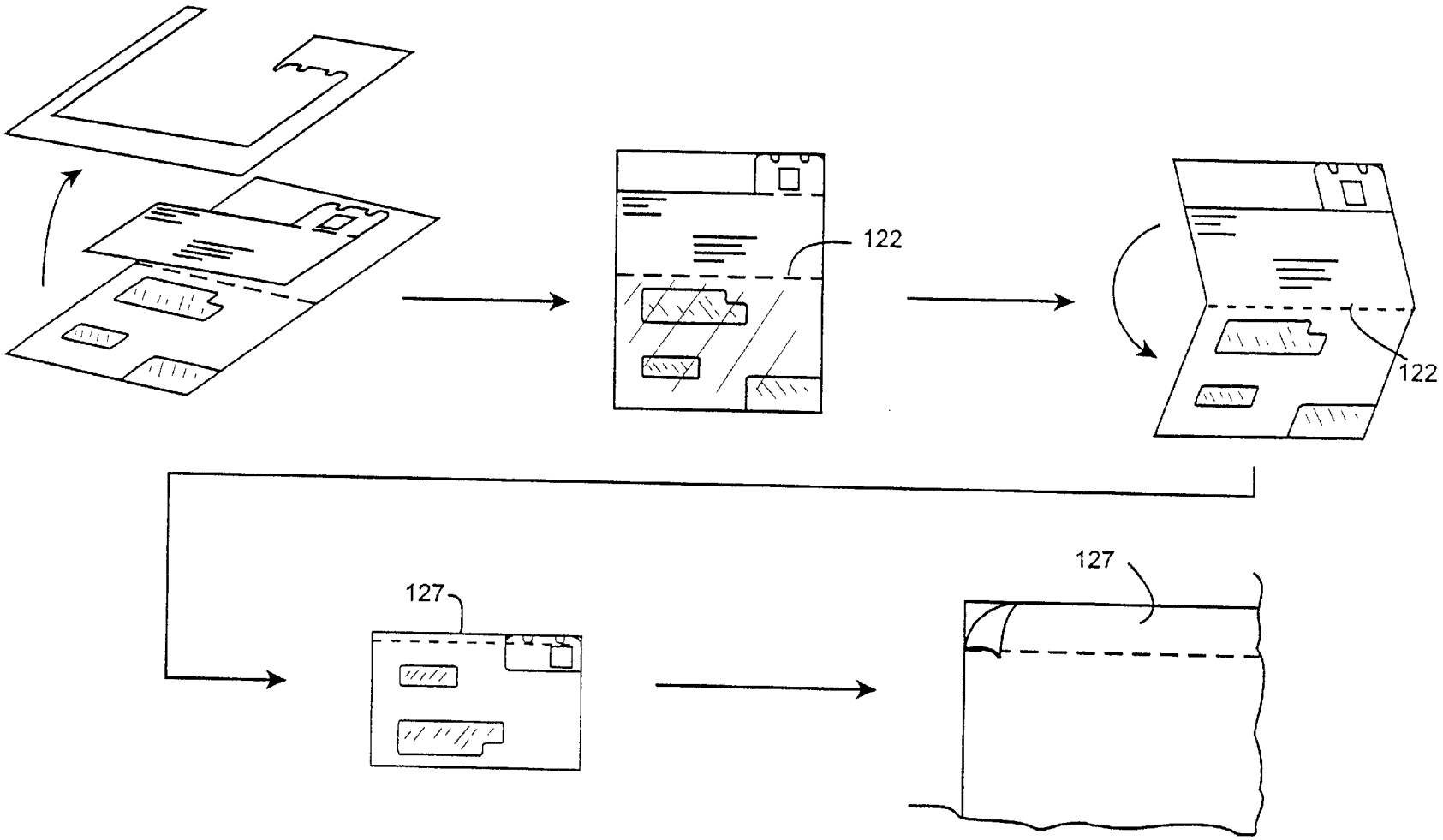
FIG. 13 shows a stepwise process illustrating the correct placement of IBI postage indicia in the upper right-hand corner of the outgoing envelope, including positioning of a FIM mark ⅛ of an inch or less from a top edge of the envelope.

FIG. 13 shows a stepwise process illustrating the correct placement of IBI postage indicia in the upper right-hand corner of the outgoing envelope, including positioning of a FIM mark ⅛ of an inch or less from (preferably flush with) a top edge 125 of the outgoing envelope. After strip 104 is removed, the inner flap is Z-folded into position to place the postal indicia portion 111 in accordance with USPS requirements. The form is folded along fold line 122 and sealed along the perimeter edges to form the outgoing envelope. A recipient of the envelope can then remove strip 127 to permit access to the information contained within it.

Figure 14:
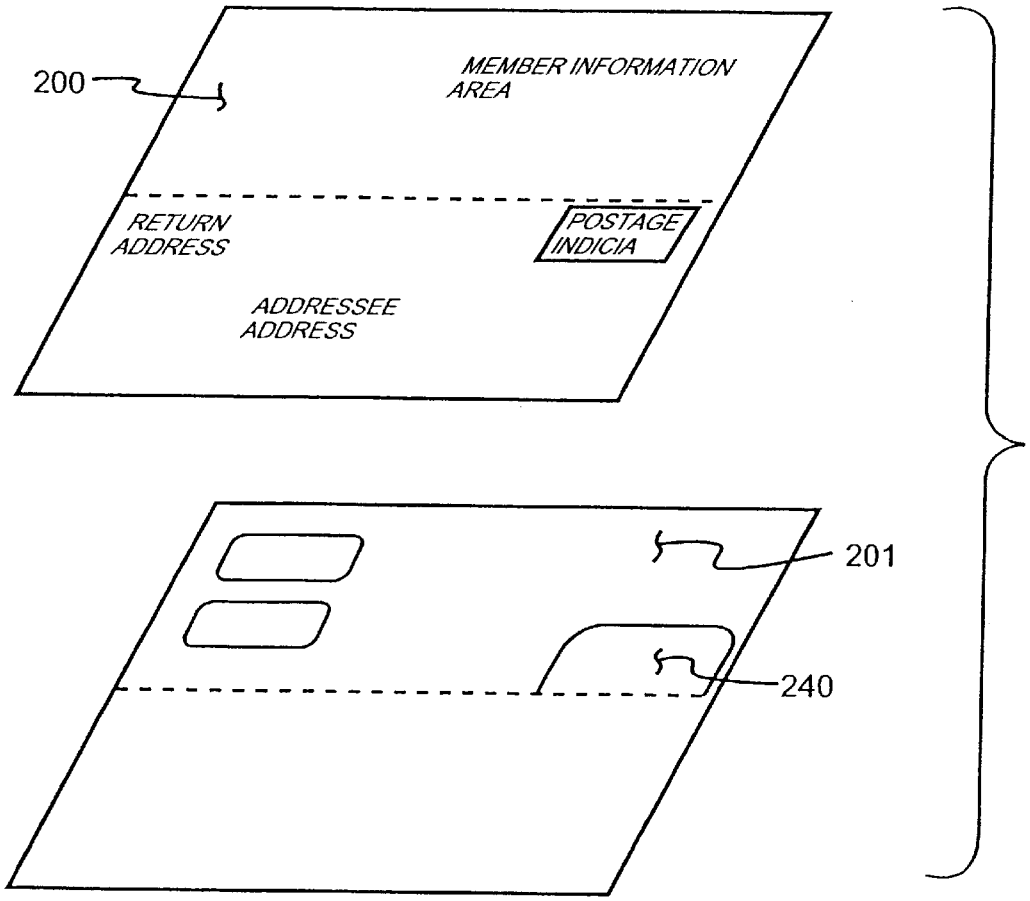
FIG. 14 shows in perspective, exploded view, a front face of a top substantially transparent layer and a front (inner) face of a bottom substantially opaque layer forming a separate embodiment of a mailer form. The positioning of a postage indicia window area on the opaque sheet is also illustrated.

A third embodiment of the subject invention concerns an IBI postage indicia window as applied to a two-ply mailer blank described in U.S. Pat. No. 5,791,553 and its progeny, U.S. patent application Ser. No. 09/132,036, which are hereby incorporated by reference. Specifically, FIG. 14 shows, in perspective view, a front face of a top substantially transparent layer 200 and a front (inner) face of a bottom substantially opaque layer 201 illustrating the positioning of a postage indicia window area 240 on the opaque sheet. The postage indicia are printed in area 241 such that it can be viewed when the mailer blank is in the folded configuration.

Figure 15:
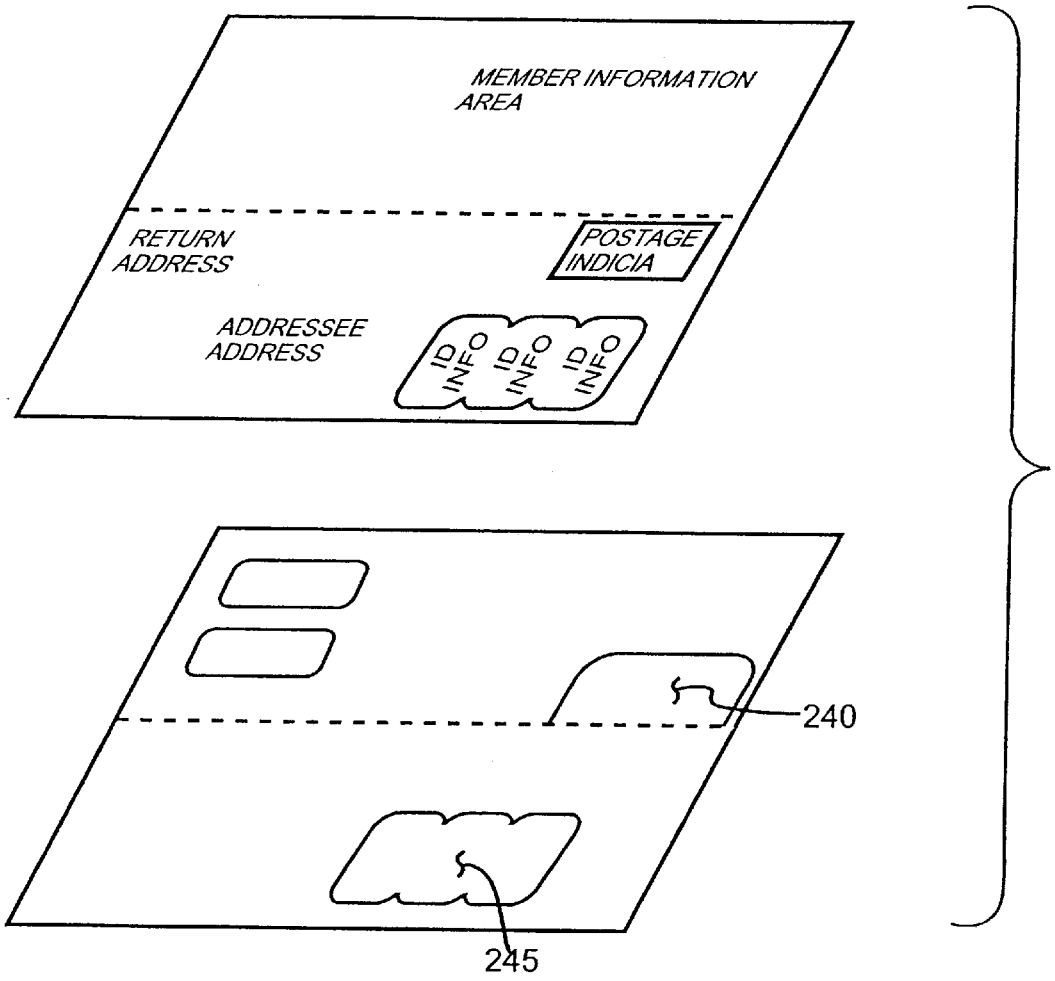
FIG. 15 shows a two-ply mailer blank as in FIG. 14, but further comprising an identification card portion in relation to a postage indicia window and postage indicia area.

FIG. 15 shows a two-ply mailer blank as in FIG. 14, but further comprising a removable identification card portion in relation to a postage indicia window 240 and postage indicia area 241.

A further embodiment of the subject invention is shown in FIGS. 16–28B. In this embodiment, the mailer form comprises a substantially two-ply correspondence form machine-foldable into an outgoing mailer envelope. The correspondence form has, integral therewith, a separable return envelope which is formed by further folding of one of the two plies prior to superimposing the two plies together as a single, two-ply form. The first, or top, ply is typically a rectangular sheet having dimensions of a standard size sheet of paper, e.g., 8½×11 inches, 8½×14 inches, or A4. The second, or bottom, ply is a rectangular sheet having dimensions which are the same width as the top ply but, in its initial manufacturing stage, is long enough to be folded at least twice to form a return envelope of sufficient size to contain a return receipt, check for payment, return correspondence or other document. The first fold forms a pocket for the return envelope and this formed return envelope is then folded a second time to make the bottom ply substantially equal in length to the top ply, and thereby forming a return envelope contained within the top and bottom plies.

Figure 16:
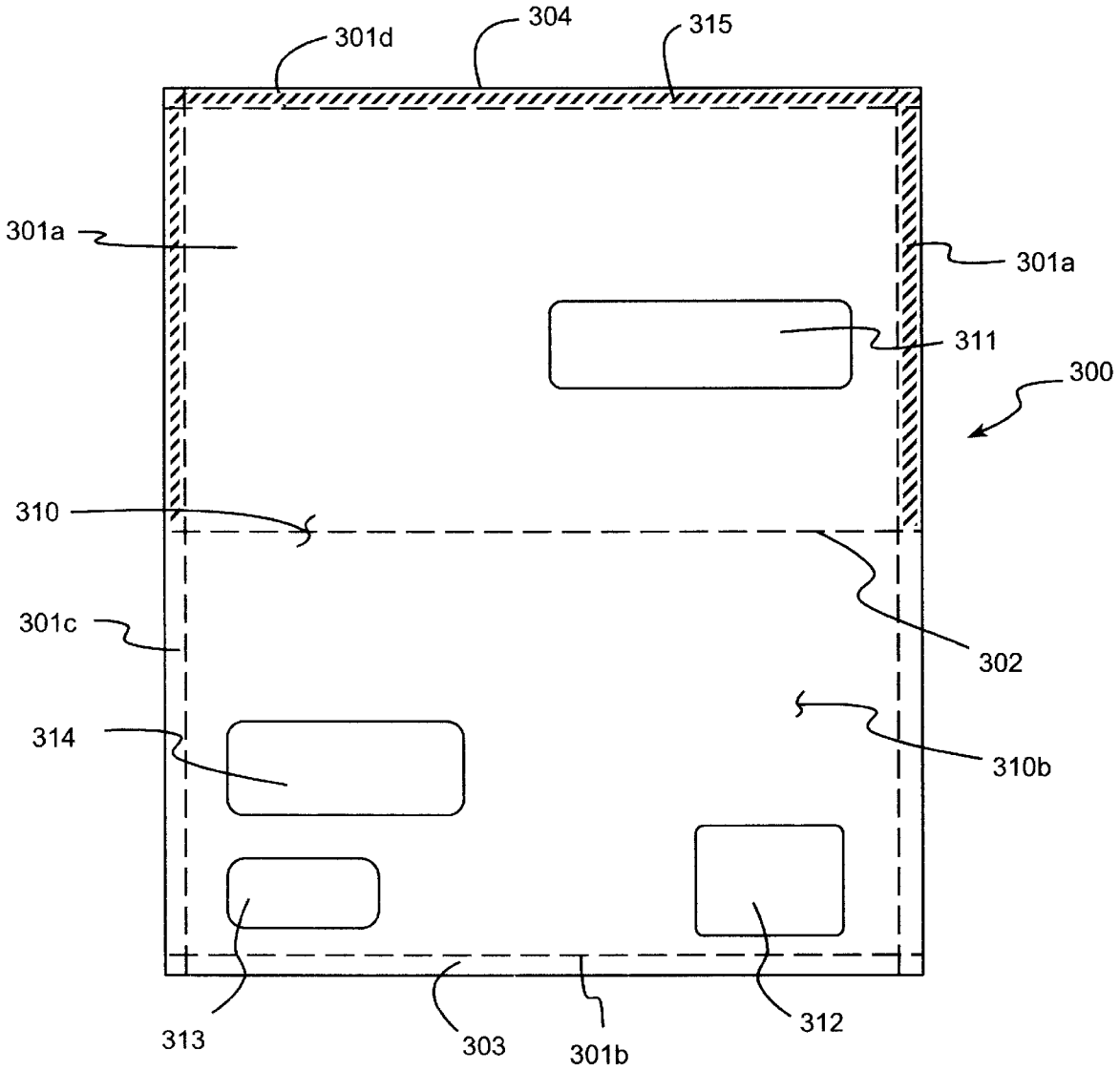

Referring to FIG. 16, a plan view of a front (outer) face of a top ply 300 of the correspondence/mailer/return envelope form is shown in its extended (open) configuration. Perforation 302 forms a fold line along the horizontal mid-line of the form, dividing face 310 of the form into two sections 310*a* and 310*b*. Folding of the form along perforation 302 brings sections 310*a* and 310*b* in contact with one another and aligns edges 303 and 304.

Front face 310 can receive variable and static printed information when passed through a simplex non-impact printer. A substantial portion of front face 310 can be useful for printing static information such as correspondence, e.g., a letter, to the addressee. The space available for printing such correspondence excludes only the areas outside the perimeter perforations 301*a*, 301*b*, 301*c*, and 301*d*, areas requiring variable address information or postage indicia, window areas 312–314, and label area 311. Label area 311 is uniquely provided as a retained die-cut label. To prevent the die-cut edges of the label from catching or otherwise jamming in the printer feeder or paper path, the die-cut can be made incomplete, leaving small non-cut "ties" along the edge of the die-cut. The retained die-cut configuration allows label area 311 to be a part of, or integral with, face 310 when receiving variable printed information, but further allows label area 311 to be easily removed from top ply 300 after becoming affixed to a permanent adhesive disposed on a corresponding area of the return envelope. The affixation of label area 311 to the adhesive disposed on the return envelope allows the "ties" to be easily broken such that label area 311 transfers as an address label onto the return envelope in the addressee address area of the return envelope.

Window areas 312–314 are open areas formed by die-cuts through the ply. Window areas can optionally be backed by a transparent covering for protecting internal plies and to preclude damaging the form when processed on postal sorting equipment. These window areas are positioned so that printed information, preferably variable information such as address information and postage indicia for the outgoing mailer envelope can show and be viewed through the open window areas. For example, window area 312 on section 310*b* is positioned such that variable postage indicia printed in a corresponding area of section 310*a* shows and can be viewed through said window area. Window areas 313 and 314 in section 310*b* of the form are similarly strategically positioned, but to allow different variable information printed on section 310*a* to show and be viewed therethrough. For example, in the embodiment shown, window 313 is positioned such that variable return address information for the outgoing mailer envelope, printed in a corresponding area on section 310*a*, shows and can be viewed through this window area; window 314 is positioned to allow addressee information printed on a corresponding area of section 310*a* can show and be viewed through this window.

Face 310 of the form also includes perforations 301*a*, 301*b*, 301*c*, and 301*d* along each of its respective edges. Preferably, these perforations are formed approximately ¼–½ inches from the outer edge of the form and provide for tear-off strips which can be removed by the receiver of the form to open the outgoing envelope.

In order to seal the outgoing envelope after printed information has been entered or applied using a non-impact printer, an adhesive, preferably a pressure-activated adhesive, can be disposed between the edges of the form and the perforations forming the tear-off strips. The adhesive can be disposed on the entire perimeter of the form, but is preferably disposed only on three perimeter edges of one of the sections 310*a* or 310*b*. FIG. 16 shows pressure-activated adhesive 315 (striations) disposed only on section 310*a*, parallel to and between edge 304 and perforation 301*d*, and parallel to and between perforations 301*a* and 301*c* and their respective edges. It would be understood that adhesive could be disposed on those edges opposing the edges shown to have adhesive disposed thereon, or any combination thereof so long as a seal is formed along the three edges of the form which have removable tear-off strips. Adhesive can also be disposed on both facing surfaces to provide better adhesive saturation and adherence.

As can be ascertained from the illustration in FIG. 16, folding of the form along perforation fold-line 302, whereby sections 310*a* and 310*b* meet one another, provides a tear-off strip along each of three edges of the folded form. Removal of these tear-off strips from these three edges allows the integrity of the form to be maintained along the perforation fold-line 302.

It would be understood that use as the plies of the mailer form of 8½×14 inch sheets folded in half along a horizontal midline would result in a mailer that is larger than the standard size accepted by the USPS, and would therefore require additional postage. Accordingly, a variation of the form can be provided wherein the fold line 302 at the midline is instead substituted as two fold lines approximately one-third the distance from each end of the sheet forming a middle section and two end sections. It would be understood that the bottom plies used in this configuration would have corresponding fold lines. These fold lines can be used to fold the mailer in a C-fold or Z-fold configuration such that each end section is superimposed over the middle section. In a C-folded configuration, the pressure-activated adhesive can be disposed on the outer edges of either end section. In a Z-folded configuration, adhesive can be disposed on a front face of the top ply of one of these sections and on a back face of the bottom ply on the other of these sections.

Figure 17:
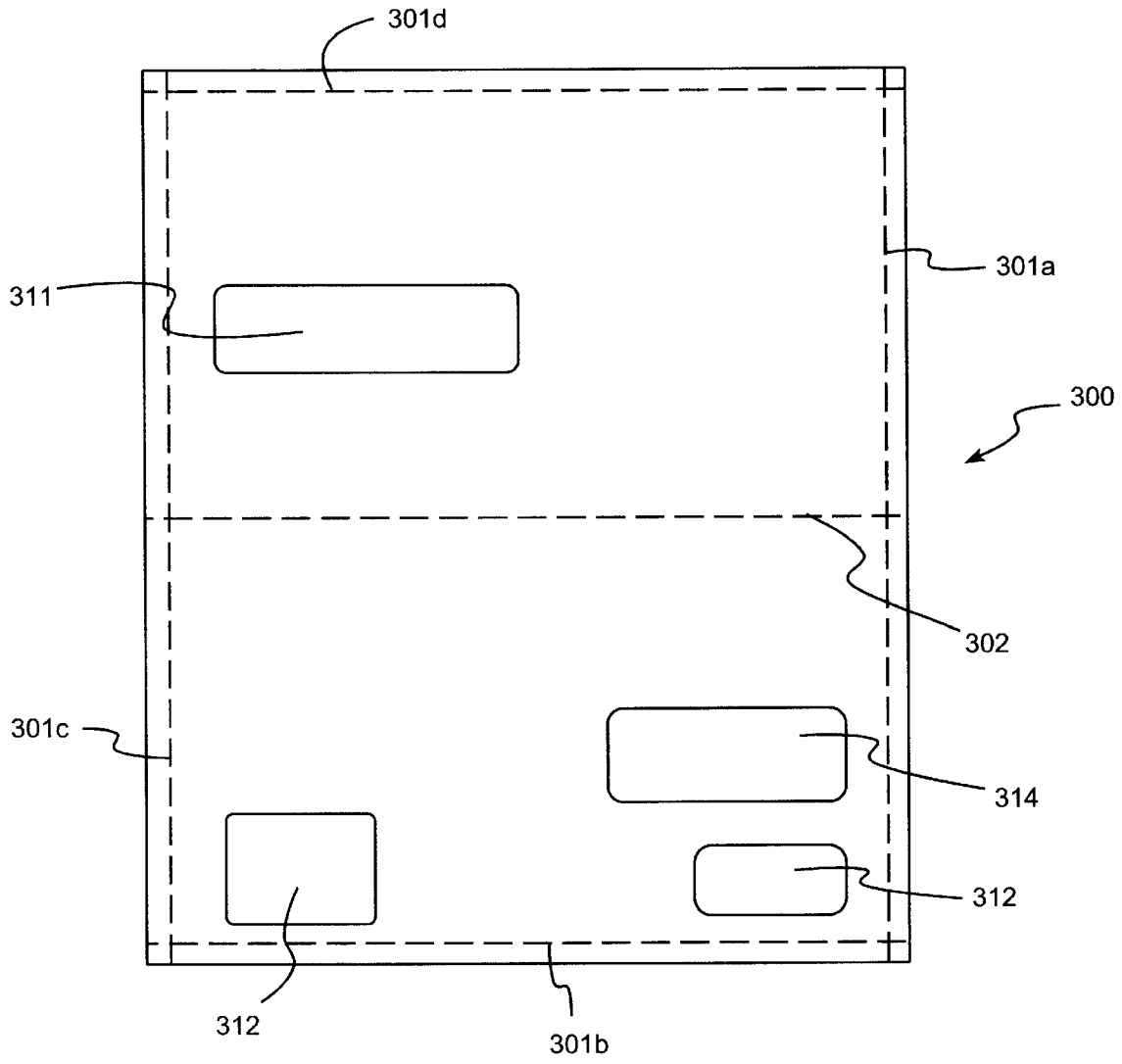

FIG. 17 is a plan view of a back (inner) face of a top ply 300 of the correspondence/mailer/return envelope embodiment, in extended configuration, according to the subject invention. Illustrated are perforations 301*a*, 301*b*, 301*c*, and 301*d*, along the perimeter edges of the form. Also shown is the horizontal perforation fold-line 302 transverse to the longitudinal dimension of the form. This back (inner) face of top ply 300 is shown as a mirror-image of FIG. 16, illustrating area 311 and window areas 312–314 positioned as seen if FIG. 16 were viewed from its reverse face. Notably, this back face of top ply 300 does not include the pressure-activated adhesive along its perimeter edges as shown in FIG. 16. This inner face of top ply 300 is available for pre-printing of static information, e.g., a second page of text in the correspondence letter or other communication sent by the sender of the mailer. The surface on the inner face of the bottom ply which faces the inner face of the top ply (see FIGS. 18A and 18B, and the accompanying text, below) can receive static pre-printed information for providing an additional (e.g., third) page of text. For a mailer which does not need a second or third page of text, it would be understood that these facing pages can be permanently adhered together.

Figure 18A:
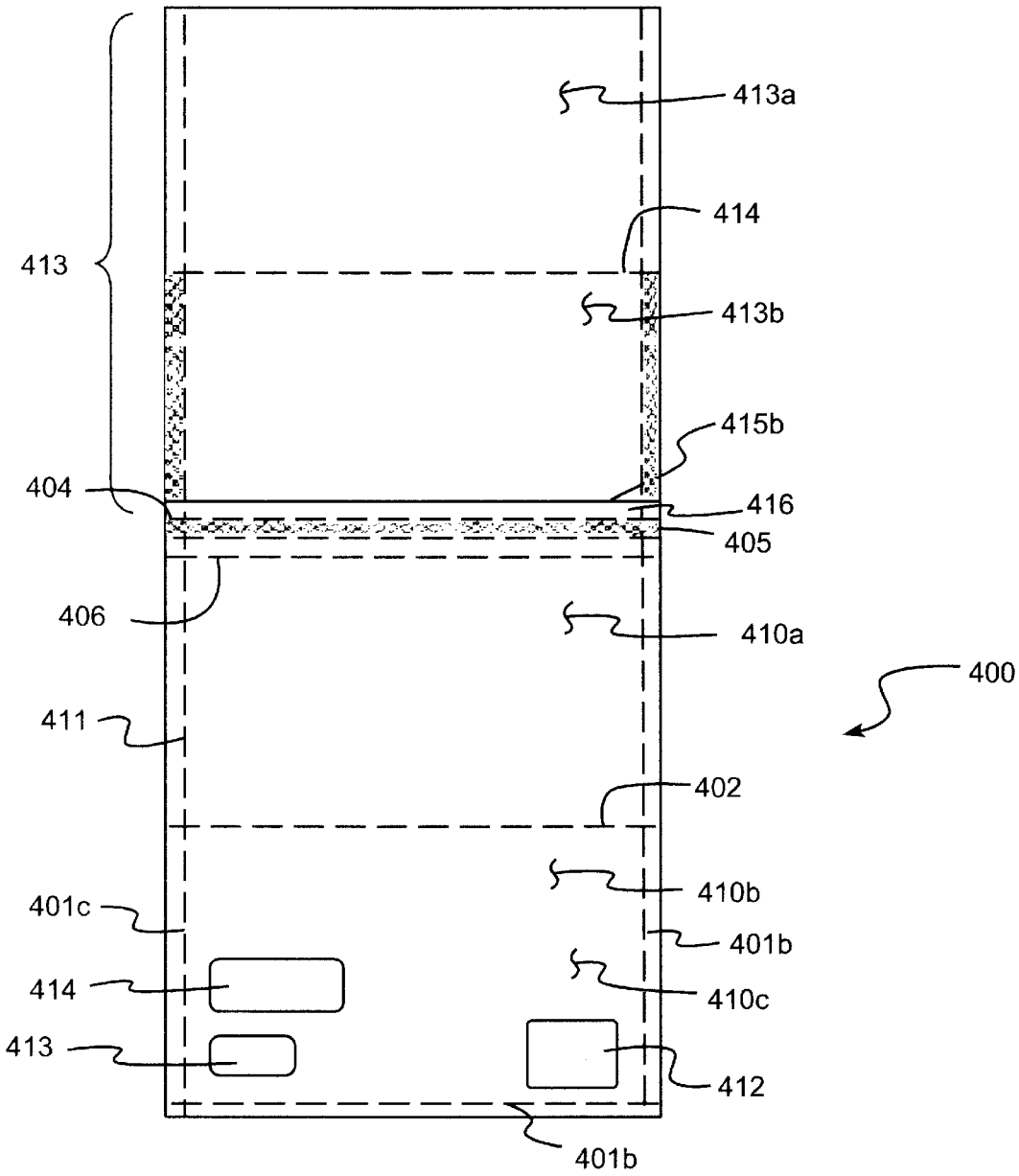
FIG. 18A is a plan view of a back (outer) face of a bottom ply of the correspondence/mailer/return envelope embodiment, in extended configuration, according to the subject invention.

FIG. 18A is a plan view of a back (outer) face of a bottom ply 400 of the correspondence/mailer/return envelope embodiment, in its extended configuration. The bottom ply 400 comprises section 410*b*, which corresponds to section 310*b* of the front ply. Section 410*b* includes windows 412, 413, and 414, formed by die-cuts through the bottom ply, corresponding to windows 312, 313, and 314 of the top ply, and are illustrated in FIG. 18A having an optional transparent backing which is adhered to the inner face of bottom ply 400. This transparent backing can also be configured such that it extends past the top edge of the form whereby it can be folded over the top ply to provide reinforcement for the top-opening tear strip. See also FIG. 28A. In addition, a further variation of the form can include windows which are cut out to the edge of the form, such as in the embodiment shown in FIGS. 10–12B, but adapted for this embodiment, and allows a facing identification mark (FIM) printed flush with the top edge of the mailer envelope to be viewed through the window. The transparent sheet folded over the top edge of the top ply can also provide a continuous leading edge for this variation. Perforations 401*a*, 401*b*, and 401*c* are formed in section 410*b* to correspond with perimeter perforations in the top ply, forming removable tear-off strips. In addition, a perforation fold-line 402 is formed in bottom ply 401 and divides section 410*b* from 410*a*. Section 410*a*, which is formed between perforation fold-line 402 and perforation fold-line 404 corresponds to section 310*a* of the front ply, but section 410*a* does not include a section corresponding to section 311. Section 410*a* forms the back face of the outgoing mailer and includes perforations 411 and 421 forming removable tear-off side strips. A removable, tear-off end strip is formed by a fold formed along fold-line 405, matching perforation 404 to 406. These perforations 404 and 406 are formed approximately ¼ to ½ inches on either side of perforation fold-line 404.

Return envelope portion, folded along fold-line 414, forms a front face 413*b* and back face 413*a* of return envelope portion 413. A score line 415 is also provided in return envelope portion 413, forming a fold guide for a sealing flap 416 for return envelope portion 413. Postage indicia area 417 and return address area 418 can be pre-printed on the return envelope. In addition, a pressure-sensitive adhesive can be provided in address area 420. This address area 420, when the return envelope is in its folded configuration and contained within the outgoing mailer, matches to address label area 311 of the top ply and adheres the address label 311 thereto. When the mailer is opened by the original addressee, the label area 311 is retained with the bottom ply in address area 420 of the return envelope portion 413.

Permanent adhesive (stippling), as is well known in the art, can be disposed on the tear-away strip formed between fold-line 404 and perforation 405, as well as on the tear-away side strip bordered by score-line 415, fold-line 414, perforation 411 and its nearest edge, and the tear-away side strip bordered by score line 415, fold-line 414, perforation 421 and its nearest edge. Alternatively, pressure-activated adhesive can be used in order to allow for shifting of the plies in relation to one another prior to activation of the adhesive.

Figure 18B:
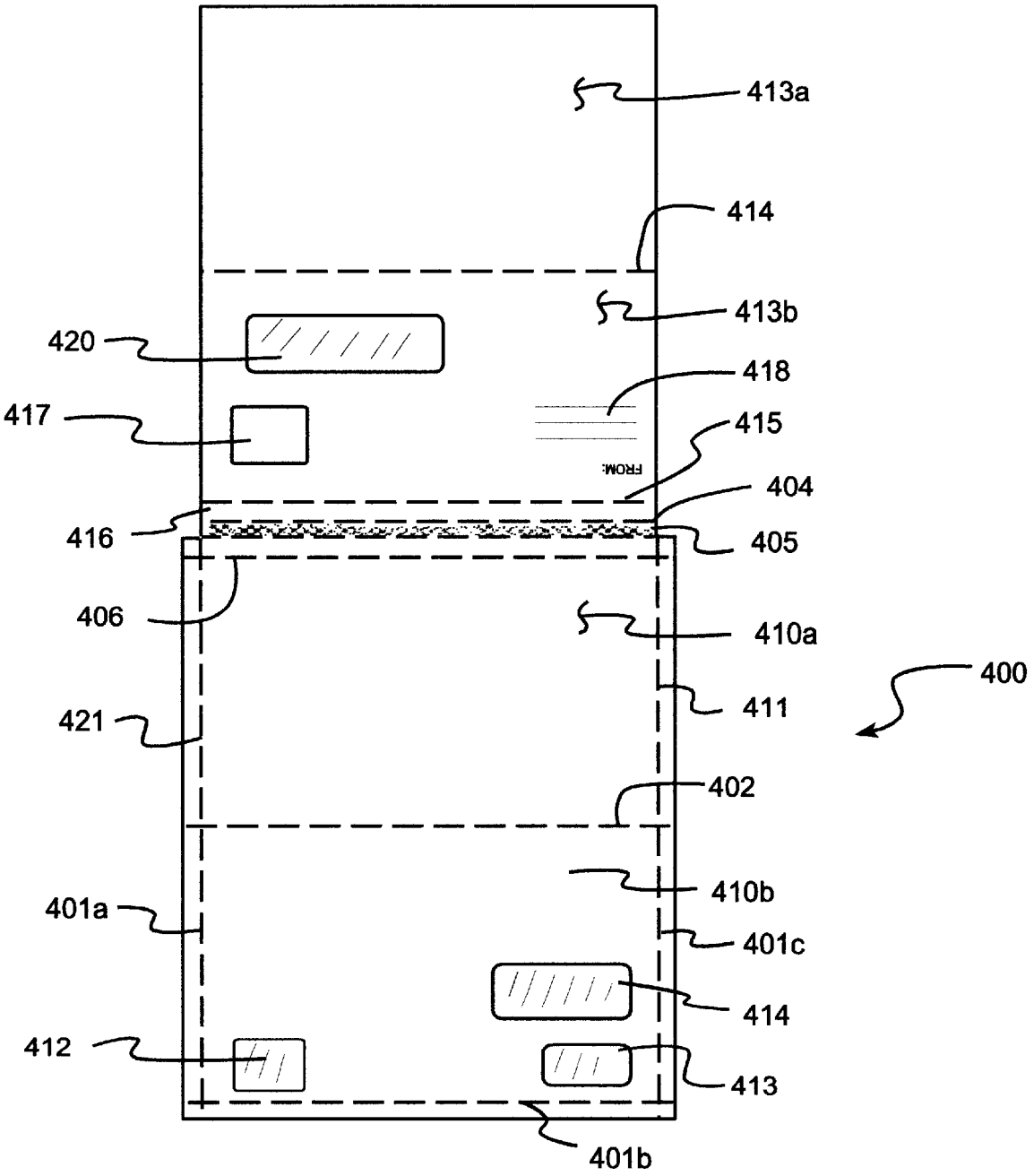
FIG. 18B is a plan view of a back (outer) face of a bottom ply of the correspondence/mailer/return envelope embodiment, in extended configuration, according to the subject invention, showing tear-off edges removed from the return envelope portion forming a "chip-out" configuration.

Additionally, a die-cutter can be used to remove the edge tear-off strips from the envelope portion, resulting in a "chip-out" configuration, shown in FIG. 18B. In this configuration, removal of the tear-off strip bordering the side edges of the return envelope provides an envelope which is separated from the corresponding side edges of the bottom ply and folds to fit completely within the top and bottom plies. The return envelope is therefore connected to the bottom ply only along the perforation dividing the mailer from return envelope seal flap 416. This chip-out configuration can allow the return envelope to shift relative to the outer plies such that the form can more easily feed through a printer.

Figure 19:
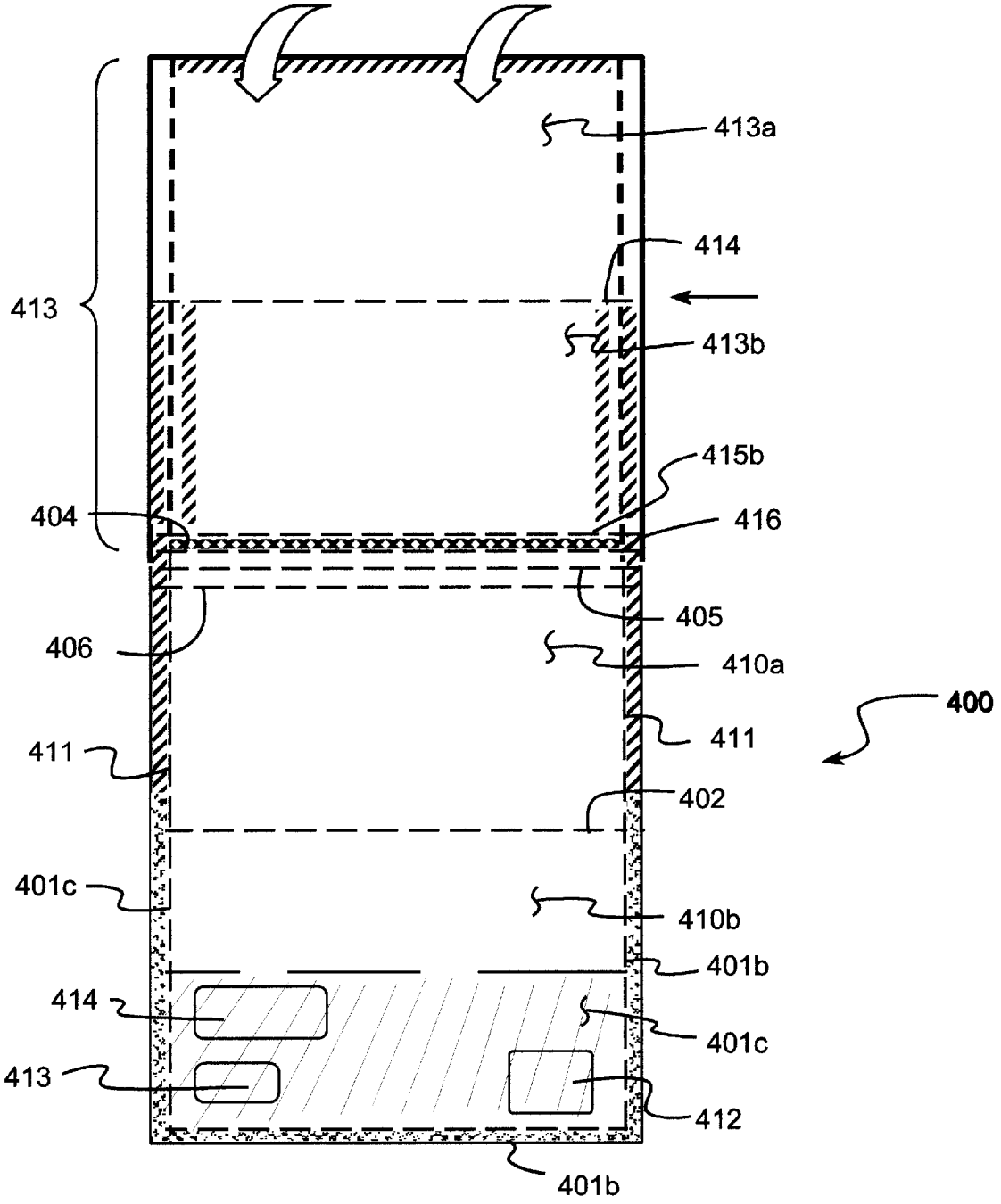

FIG. 19 is a plan view of a front (inner) face of a bottom ply 400 of the correspondence/mailer/return envelope embodiment, in its extended configuration and is shown as a mirror image to FIG. 18A. As in FIG. 18A, the front, inner face of bottom ply 400 shown in FIG. 19 comprises section 410*b*, which corresponds to section 310*b* of the front ply. Section 410*b* includes windows 412, 413, and 414, formed by die-cuts through the bottom ply, corresponding to windows 312, 313, and 314 of the top ply, and are illustrated here in FIG. 18A having an optional transparent backing 410*c* adhered thereto. Perforations 401*a*, 401*b*, and 401*c* are formed in section 410*b* to correspond with perimeter perforations in the top ply, forming removable tear-off strips. In addition, a perforation fold-line 402 is formed in bottom ply 401 and divides section 410*b* from 410*a*.

Three types of adhesive are preferably disposed on the inner face of bottom ply 400. For closing and sealing the mailer envelope, permanent adhesive (stippling) can do be provided along three perimeter edges of sections 410*b*, between perforations 410*a*, 410*b*, and 410*c* and their respective outer edges. The permanent adhesive extends onto section 410*a* approximately one inch past perforation fold-line 402, along perforations 410*a* and 410*c*. In addition, a pressure-activated adhesive (hatching) can be provided for sealing the mailer portion. This adhesive is disposed between perforation 411 and its nearest edge, and between perforation 421 and its nearest edge, extending from permanent adhesive on section 410*a* to perforation fold-line 405. A gap in this adhesive outside perforations 411 and 421 forms an adhesive-free area between perforation fold-line 405 and perforation 404, but then is continued from perforation 404 to fold line 414. A second strip of pressure-activated adhesive is disposed just inside perforations 411 and 421 from return envelope score line 415*b* to perforation fold-line 414, in order to provide a seal along the return envelope 413 after the edge tear-off strips are removed. The third type of adhesive which can be disposed on this face of the form is a remoistenable adhesive (cross-hatching) disposed on section 416 for sealing the opening of the return envelope for returning payment or other correspondence therein. Alternatively, the return envelope flap 416 can have a permanent adhesive disposed thereon. It would be understood that in this variation using permanent adhesive, section 413*a* would be provided with a strip of optional adhesive release material 452, just below and parallel to edge 450. The adhesive release strip 452 would preferably have a width approximately equal to the width of flap seal section 416. Folding along fold line 414 to construct the return envelope portion brings edge 450 to meet fold line 405. Preferably, the adhesive for return envelope flap 416 would be disposed onto this release material, then transferred to the flap 416 when the return envelope is formed. Once edge 450 and fold line 405 are mated, a die-cut can be formed through the single layer of section 413*a*, and aligned with score line 415*b*, thereby providing a removable protective covering for the adhesive disposed on the return envelope flap 416.

Figure 20:
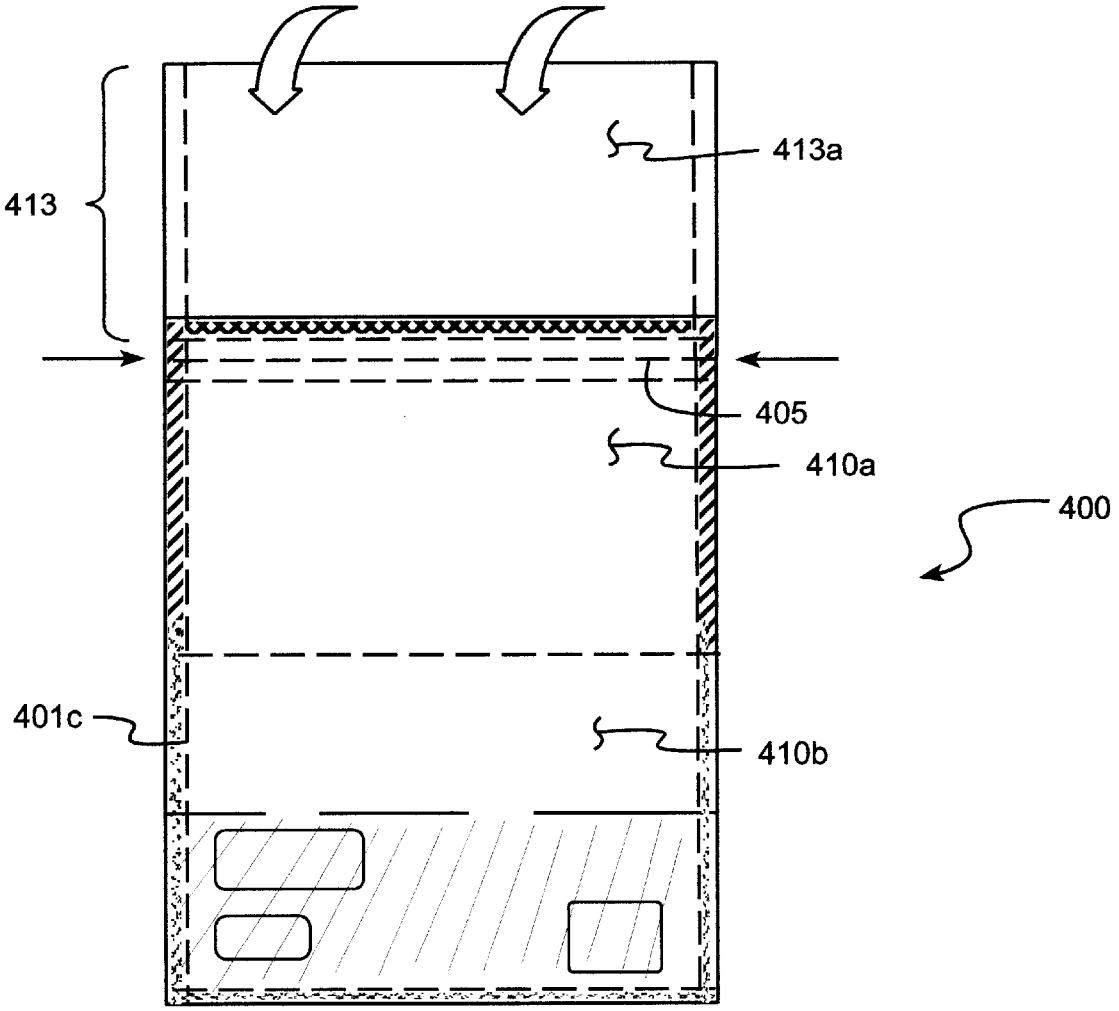

Once this bottom ply is formed and adhesive and adhesive-release material are disposed in the proper areas, the back ply can be folded to configure the return envelope and the plies can be adhered together to construct the form. First, section 413*a* is folded along fold-line 414 (solid arrow in FIG. 19), in the direction of the open arrows. The resulting fold provides the form shown in FIG. 20. FIG. 20 is the front face of the bottom ply illustrated in FIG. 19 after folding along a first fold line, thereby forming the return envelope pouch. Further folding of the bottom ply, along fold line 405 between solid arrows, and in the direction of the open arrows results in the bottom ply being. folded as shown in FIG. 21.

Figure 21:
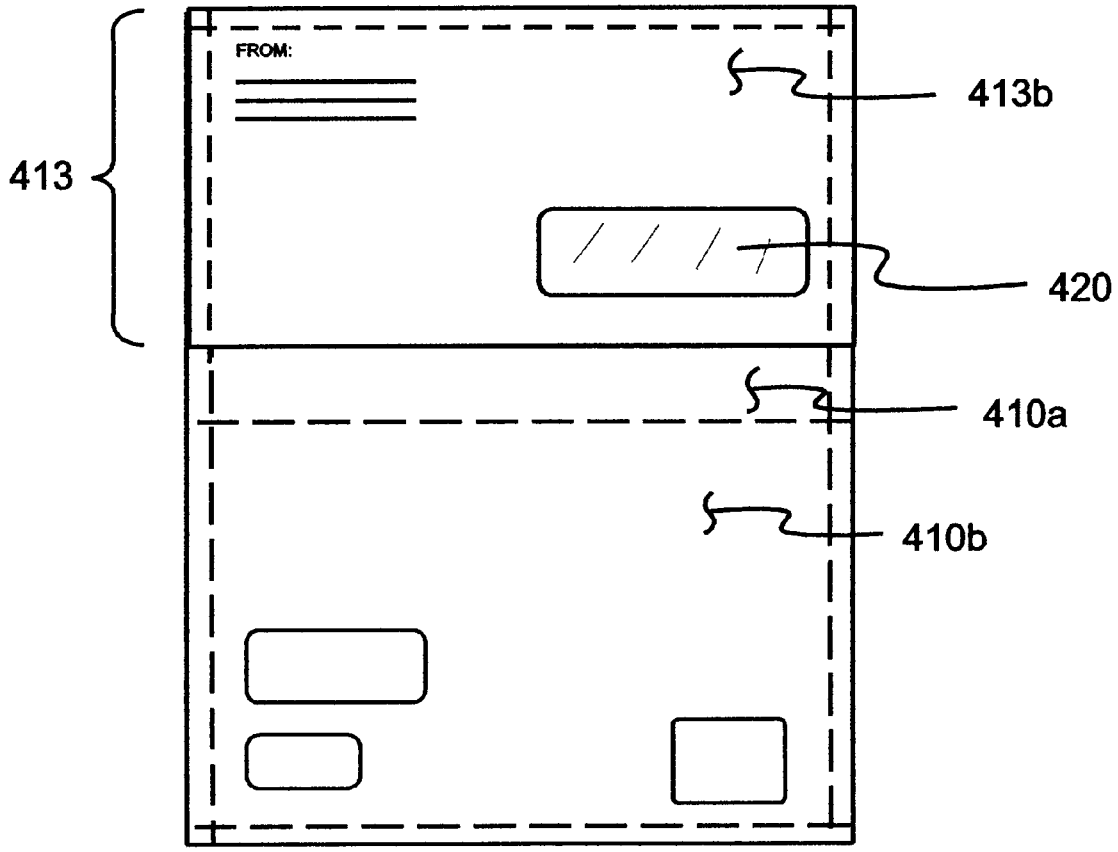

FIG. 21 is the front face of the bottom ply illustrated in FIGS. 19 and 20 after folding along a second fold line, thereby folding the return envelope portion so that it is contained within the borders of a standard-size sheet, and can be disposed between the top and bottom plies. FIG. 21 illustrates area 420 on which adhesive is disposed to receive label area 311 from the top ply.

Figure 22:
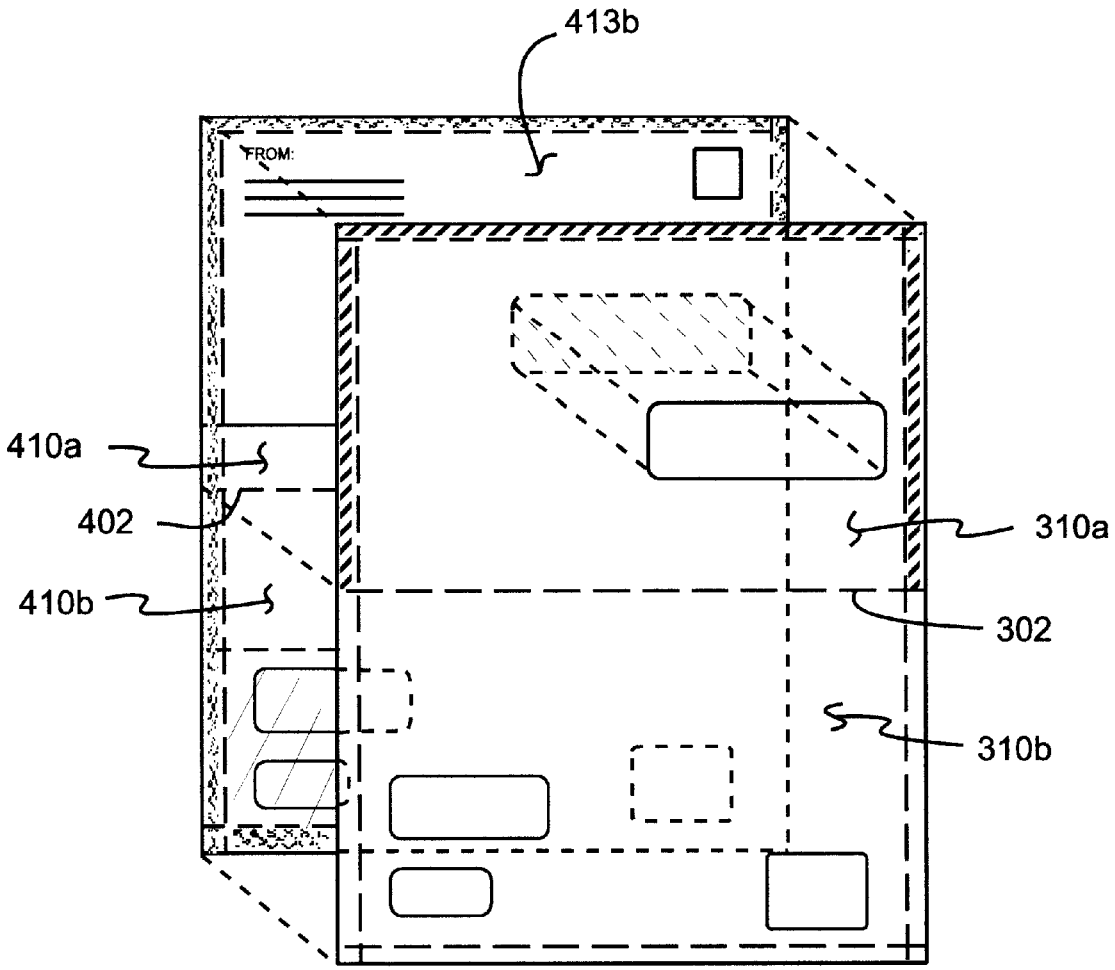

FIG. 22 is an exploded view of the top ply 300, shown, for example, in FIG. 16, and bottom ply 400 shown, for example, in FIG. 21, as they are superimposed and adhered to one another to form the form according to this embodiment of the subject invention. Certain features of the bottom ply, e.g., window areas and adhesive area are shown in phantom to illustrate their corresponding position to windows or label areas in the top ply.

Figure 23:
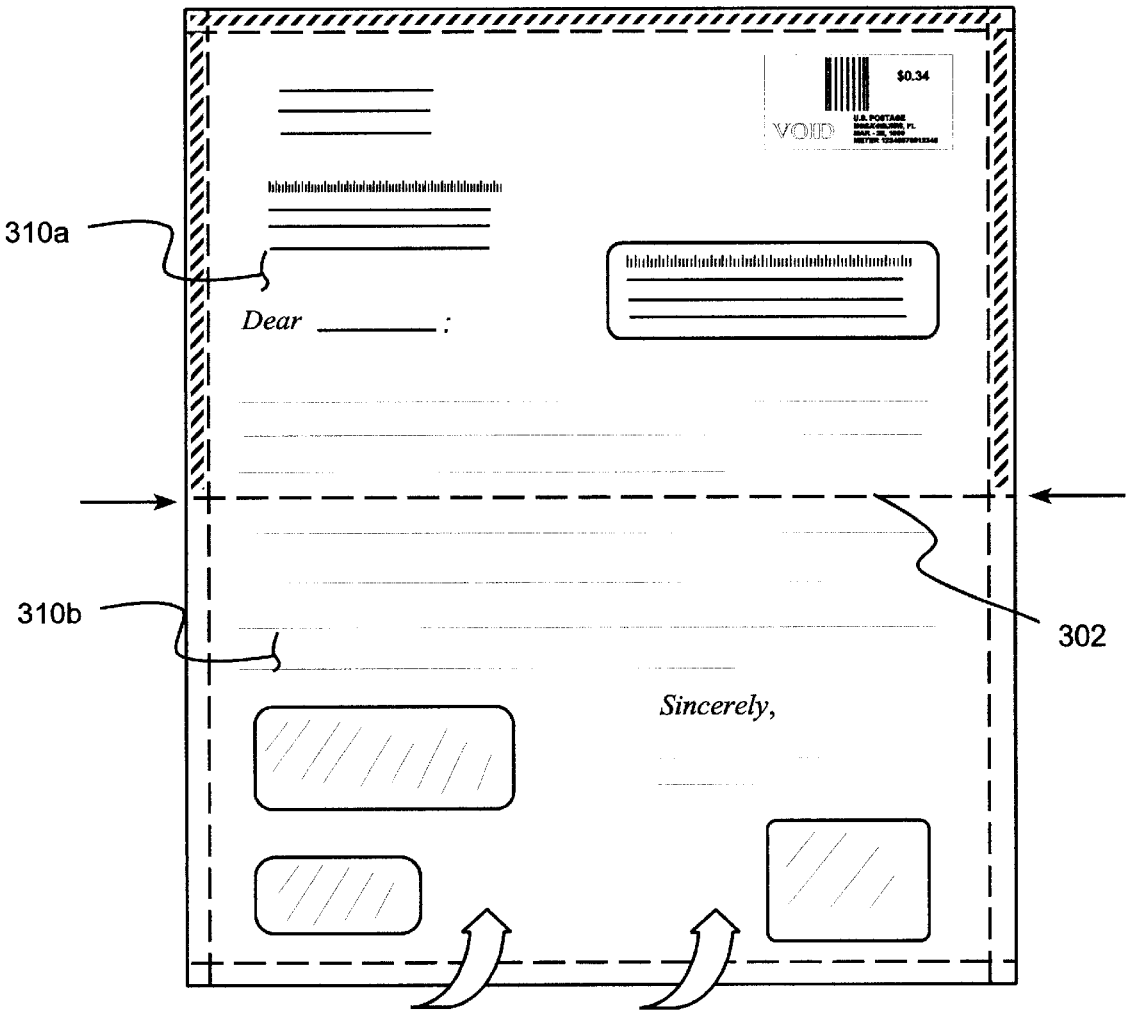

FIG. 23 is a front plan view of the outer face of the two-ply mailer form having variable and static information printed thereon after a single pass through a simplex non-impact printer. The form is then folded along the perforation fold-line 302 (solid arrows) and can be folded in the direction of the open arrows so that the inner faces of sections 310*a* and 310*b* are brought into contact with one another. The outgoing mailer is then sealed by activating the adhesive disposed on the perimeter edges of section 310*a* to the corresponding perimeter edges of section 310*b*, resulting in a folded and sealed mailer having windows through which postage indicia and address information show are shown and viewed (FIG. 24).

Figure 24:
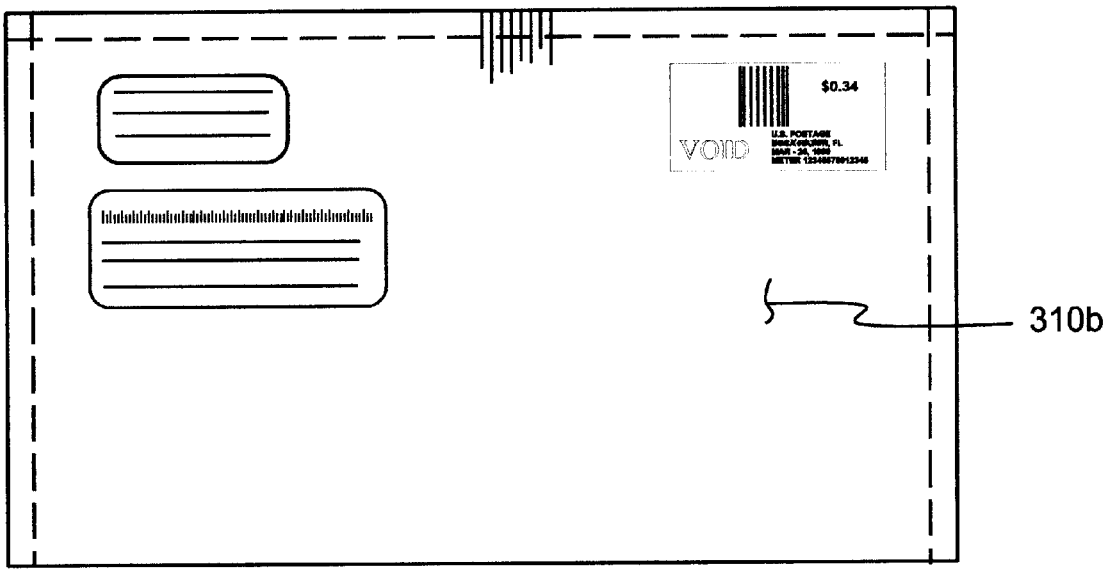
Figure 25:
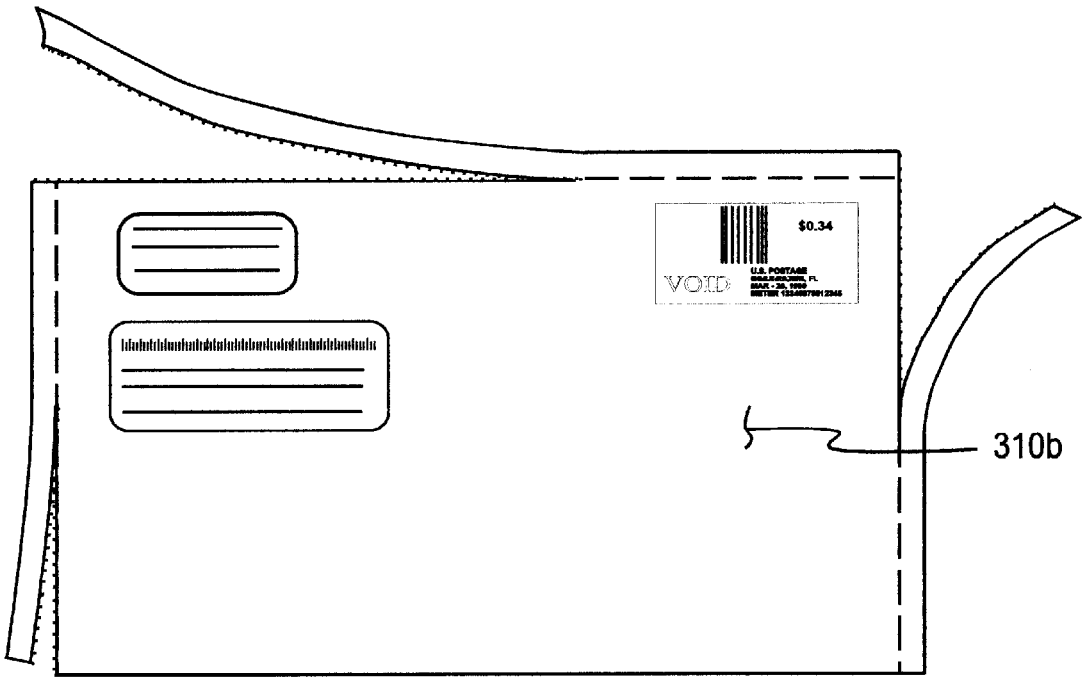

FIG. 25 is a plan view of the folded mailer shown in FIG. 24, but after being received by the addressee or recipient of the mailer, and in the process of being opened by removing the tear-off strips which were formed along the perimeter edges of the mailer.

Figure 26:
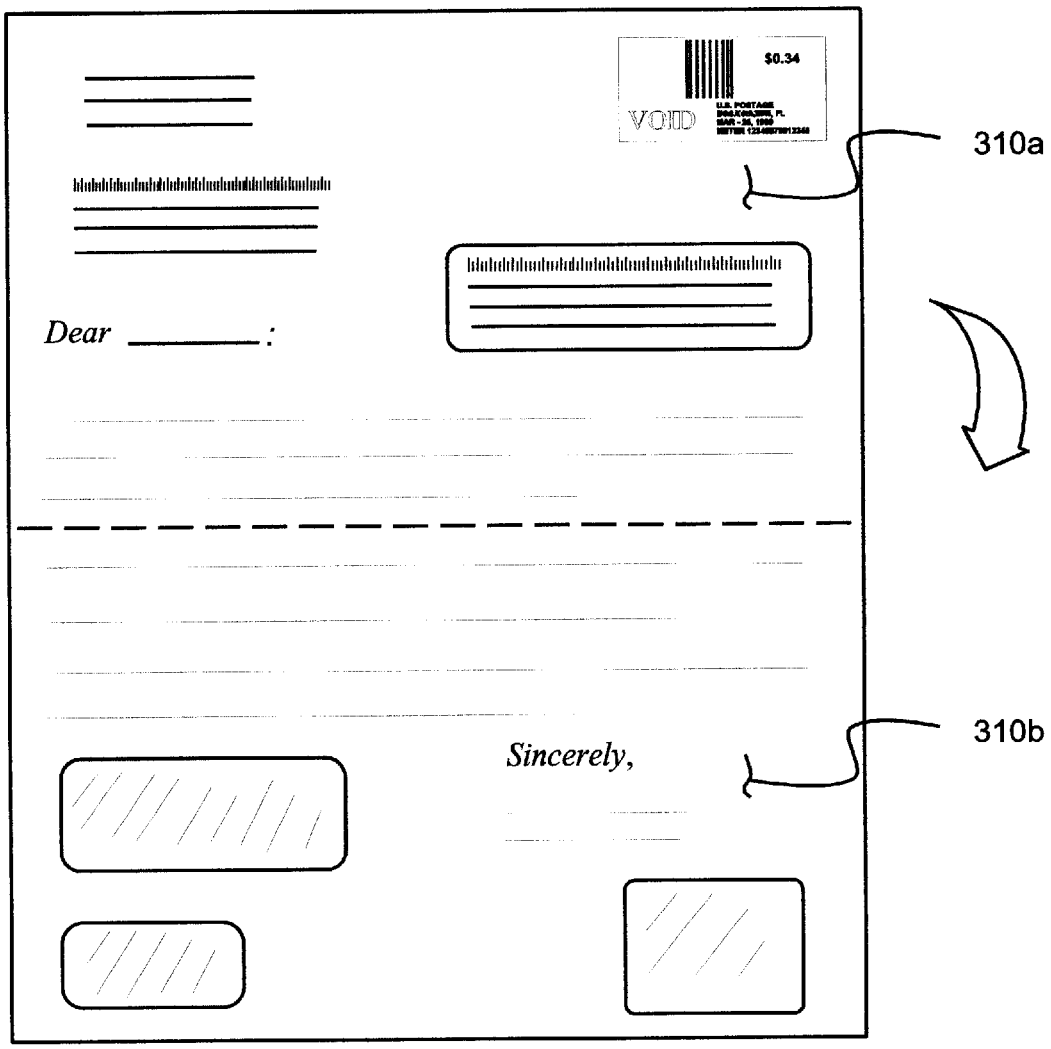

FIG. 26 is a plan view of the outer face of the top ply of the two-ply mailer after having the removable tear-off strips removed and being opened (in the direction of the open arrows) by the recipient. The Figure is identical to that shown in FIG. 23, except that the tear-off strips have been removed; therefore, the top and bottom plies are no longer adhered together. The bottom ply and return envelope are free from the top ply.

Figure 27:
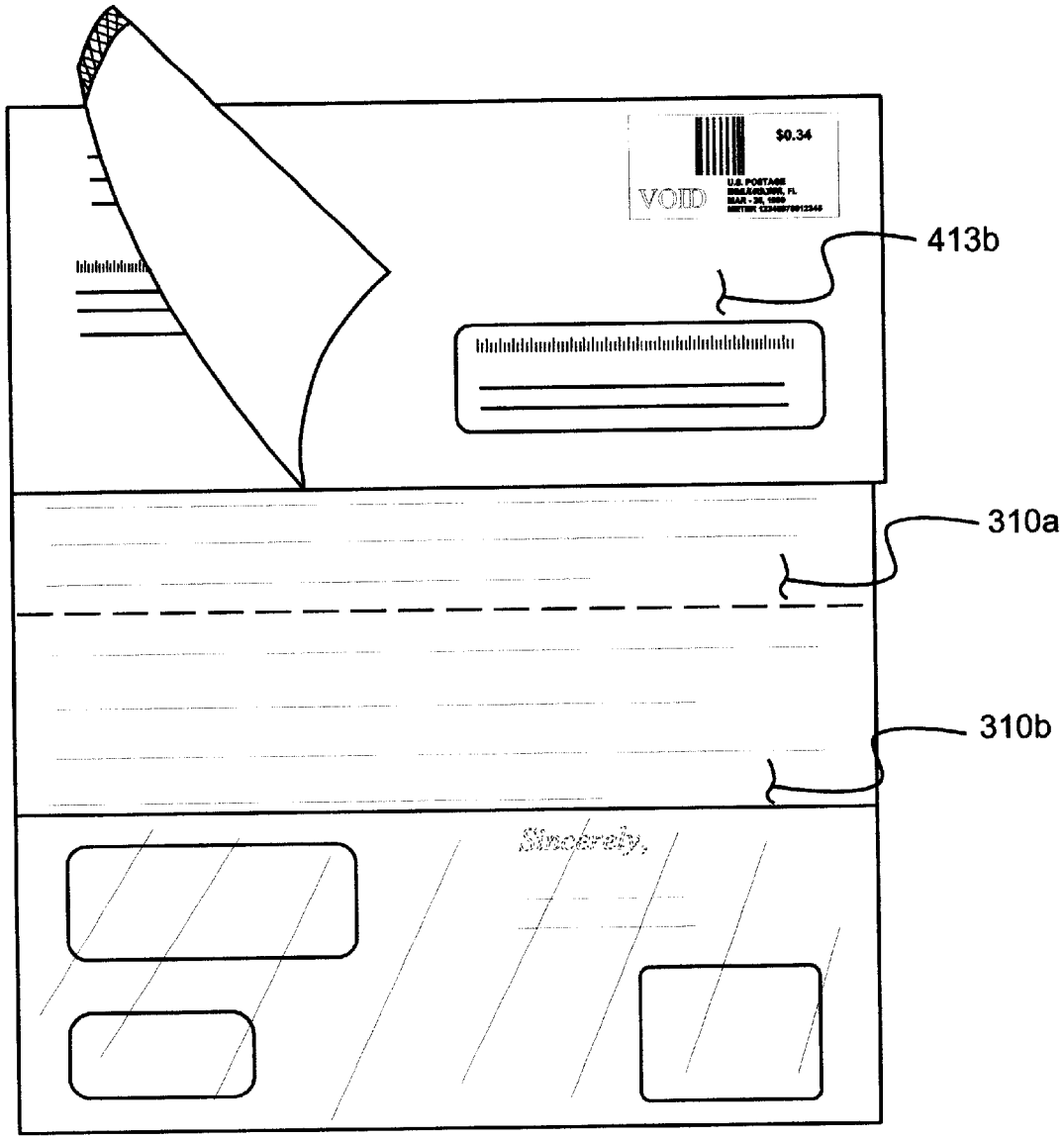

FIG. 27 is a plan view of the bottom face of the two-ply mailer, after removal of the top ply, and illustrating the return envelope portion which is now physically separated from the top and bottom plies by removal of the tear-off strips.

Figure 28A:
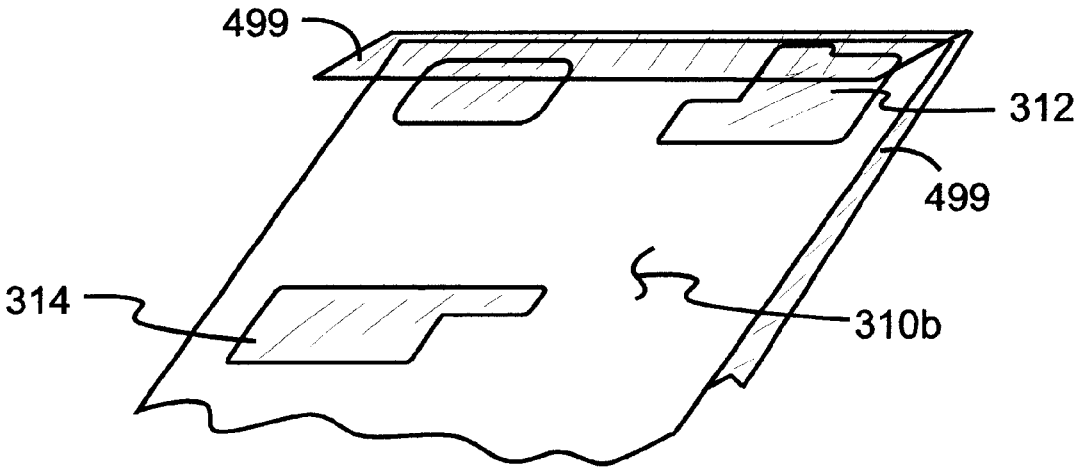
FIG. 28A shows an alternative, "stepped", configuration for certain windows formed in the top ply of the mailer envelope and a transparent backing sheet which is folded over the top edge of the top ply to provide, for example, reinforcement for the top edge.

FIG. 28A is a partial view of top ply section 310*b* having a "stair-stepped" PC Postage window 312 and "stair-stepped" addressee address window 314. These various configurations provide for viewing of additional USPS indicia, such as an 11-digit bar code in window 314 or a face identification mark (FIM) in window 312. In FIG. 28A, the PC Postage window 312 is die-cut to a top edge of the mailer ply to accommodate viewing of a FIM mark which is preferably printed on the corresponding FIG. 28A, the PC Postage window 312 is die-cut to a top edge of the mailer ply to accommodate viewing of a FIM mark which is preferably printed on the corresponding area of the bottom ply flush with the top edge. In this configuration, it is preferable to provide a transparent backing sheet 499 which extends past and folds over the top edge of the top ply such that it can reinforce or provide a continuous edge for the top ply.

Figure 28B:
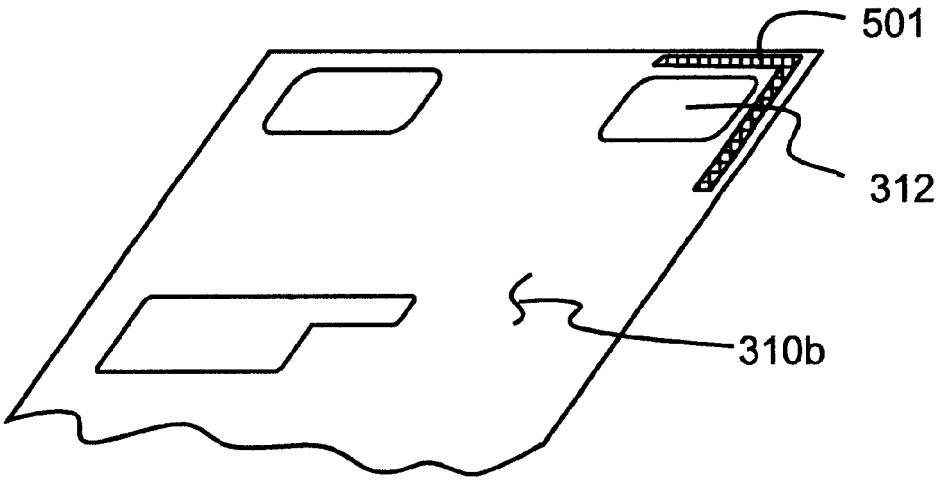

An alternative to providing a bar-coded FIM at a top edge of the top ply is illustrated in FIG. 28B, showing top ply section 310*b* having an "L"-shaped, solid bar of color printed around two outer edges of the PC Postage window 312. The USPS recognizes a fluorescent pink colored bar as a substitute for the FIM.

Compared to examples of the background art, the embodiments of the present invention combine a number of desirable features. The initial mailer envelope, in which a document is sent, the document itself, and the return envelope are all made with portions of the mailing form itself, which is preferably the size and shape of an ordinary sheet of paper, i.e., 8½ inches wide by 11 inches long.

Furthermore, all of the necessary printing of variable information can be accomplished with a single pass of the form through a simplex, non-impact printer. Therefore, any or all of the variable information, which is customized to the individual statement being sent, can be achieved with the subject forms. Thus, the address of the customer and the address of the company, on both the initial mailer envelope and on the return envelope, can be varied. Different post office boxes can be used to route the return envelopes according to the desires of the organization. A single organization can handle billing procedures for a number of different organizations. On the other hand, fixed data, such as opening instructions, can be printed on any surface of mailing form by another printing process.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention. In addition, it would be understood by those of ordinary skill in the art that certain features described for one formed in the later-described embodiments of the subject invention. Thus, certain features described herein are applicable to any and all embodiments without requiring undue experimentation on the part of a person of ordinary skill in the art. Each of these features described for one or more embodiments and applicable to other embodiments is therefore considered to be part of this invention.

I claim:

1. A combination mailing form adapted to be printed on a sheet-fed printer, said form having a correspondence portion, mailer portion, and return envelope portion, wherein variable information for each portion can be printed in a single pass through a simplex, non-impact printer, said form comprising a first ply of standard paper size having window areas to show and view the variable information and a retained die-cut label area which automatically adheres and transfers to a corresponding address area on the return envelope portion after mating of the first and second plies and printing on the non-impact printer, a second ply having window areas corresponding to the window areas of the first ply, said second ply bring substantially greater in length than the first ply such that said second ply foldably forms the return envelope portion whereby variable information printed thereon is shown and viewed through at least one window area, the plies being adhered together with an adhesive patternly disposed thereon to provide a single, two-ply form which foldably forms a mailer envelope having the return envelope contained between the first and second plies.

2. The combination mailing form of claim 1, wherein the variable information is selected from address information and postage indicia.

3. The combination mailing form of claim 1, wherein the first ply is a standard size sheet.

4. The combination mailing form of claim 1, wherein the second ply is of sufficient size to form a standard size sheet and a return envelope portion.

5. The combination mailer form of claim 1, wherein said mailer form has three different types of adhesive disposed thereon, wherein said adhesives are permanent adhesive to provide for permanent closing and sealing of the mailer or return envelope; re-moistenable adhesive to provide for a sealable closure flap on the return envelope portion; and pressure-sensitive or pressure-activated adhesive to provide adherence of the plies and a die-cut label area after the form is processed through the printer, each adhesive being disposed in different areas of the mailer to achieve its respective adhesive function.

6. The mailer form of claim 1, wherein the form further comprises a transparent backing sheet disposed between the plies to provide protection for the interior of the mailer when folded to form a mailer envelope.

7. The mailer form of claim 1, wherein the mailer includes a window area positioned on the mailer such that postage indicia printed onto the inner face of the mailer by a personal computer is viewed through said window area when the mailer is in its folded configuration.

8. The mailer form of claim 1, wherein the adhesive is pressure-activated to provide for shifting of the portions of the form relative to one another when processed through a printer feeder mechanism.

9. The mailer form of claim 1, wherein the form includes a closure flap having adhesive disposed thereon at one edge of the return envelope portion and a die-cut strip corresponding to said closure flap at an opposite edge of said return envelope portion wherein, in folded configuration of the return envelope, said die-cut strip forms a removable protective strip for the adhesive disposed on the closure flap for the return envelope portion.

10. The mailer form of claim 1, wherein the first and second plies of the mailer have top faces which provide a plurality of correspondence pages.

11. The mailer form of claim 10, wherein the first ply further has a back face which provides a third correspondence page.

12. A mailing form of claim 1, wherein the return envelope portion has edge strips which are removed prior to folding of said portion and formation of a pocket in the return envelope.

* * * * *